US006807959B1

(12) United States Patent
Murdock et al.

(10) Patent No.: US 6,807,959 B1
(45) Date of Patent: Oct. 26, 2004

(54) DEVICE USING A PNEUMATICALLY-ACTUATED CARRIER TO EJECT PROJECTILES ALONG A TRAJECTORY

(76) Inventors: Douglas B. Murdock, P.O. Box 6483, Bellevue, WA (US) 98008; Richard B. Wearn, Jr., 11927 Lakeside Ave. NE., Seattle, WA (US) 98125

( * ) Notice: Subject to any disclaimer, the term of this patent is extended or adjusted under 35 U.S.C. 154(b) by 105 days.

(21) Appl. No.: 09/494,965

(22) Filed: Jan. 31, 2000

(51) Int. Cl.[7] ..... F41B 11/00
(52) U.S. Cl. ..... 124/61; 124/73; 124/77
(58) Field of Search ..... 124/61, 70, 71, 124/73, 77; 42/105

(56) References Cited

U.S. PATENT DOCUMENTS

| | | | | | |
|---|---|---|---|---|---|
| 932,214 | A | * | 8/1909 | Wieser | 102/483 |
| 2,499,379 | A | * | 3/1950 | Garrett | 42/105 |
| 2,526,018 | A | * | 10/1950 | Foster et al. | 124/73 |
| 3,791,303 | A | * | 2/1974 | Sweeney et al. | 102/502 |
| 3,989,027 | A | | 11/1976 | Kahelin | 124/58 |
| 4,004,567 | A | | 1/1977 | Henderson | 124/61 |
| 4,086,902 | A | * | 5/1978 | Reynolds | 124/61 |
| 4,207,857 | A | | 6/1980 | Balka, Jr. | 124/56 |
| 4,273,095 | A | | 6/1981 | Speer | 124/56 |
| 4,524,749 | A | | 6/1985 | Giovagnoli | 124/7 |
| 4,784,107 | A | * | 11/1988 | Kelly | 124/61 |
| 4,834,060 | A | | 5/1989 | Greene | 124/78 |
| 4,841,945 | A | | 6/1989 | Braden | 124/78 |
| 4,877,243 | A | * | 10/1989 | Taylor | 273/26 |
| 4,995,371 | A | | 2/1991 | Kuizinas | 124/7 |
| 5,121,735 | A | * | 6/1992 | Hancock | 124/7 |
| 5,125,653 | A | * | 6/1992 | Kovacs et al. | 273/29 |
| 5,337,726 | A | * | 8/1994 | Wood | 124/61 |
| 5,496,025 | A | * | 3/1996 | Phillips et al. | 124/56 |
| 5,625,583 | A | * | 4/1997 | Otto | 124/81 |
| 5,727,538 | A | * | 3/1998 | Ellis | 124/77 |
| 5,771,621 | A | | 6/1998 | Rogers | 42/55 |
| 6,062,208 | A | * | 5/2000 | Seefeldt et al. | 124/71 |
| 6,202,636 | B1 | * | 3/2001 | O'Brien | 124/71 |

* cited by examiner

*Primary Examiner*—Peter M. Poon
*Assistant Examiner*—John W. Zerr
(74) *Attorney, Agent, or Firm*—Ronald M. Anderson

(57) ABSTRACT

A pneumatic device for firing projectiles with a charge of compressed air that accelerates a projectile carrier and the projectile through a barrel. The charge of compressed air is released into the barrel behind the projectile carrier and acts on the projectile carrier to initially accelerate it and a ball or other projectile down the barrel. The diameter of the projectile carrier is slightly less than that of the barrel and it includes a concave recess that receives balls of differing diameters, centering as they are accelerated through the barrel. The barrel is sufficiently long so that the projectile carrier comes to a halt before being ejected from the barrel. An intake for a compressor that develops the charge of compressed air is coupled in fluid communication with the barrel, behind the projectile carrier. Operation of the compressor produces a partial vacuum so that ambient air pressure forces the projectile carrier back to its firing position. An optical sensor is included adjacent to the open end of the barrel to sense when a ball has been loaded, which initiates a firing sequence, to prevent a ball from being fired if the barrel is obstructed, and to determine the velocity of a ball being ejected from the barrel.

61 Claims, 11 Drawing Sheets

10
14L
14R
15
16
18
20
21
22(TYP)
24
30
32
34(TYP)
35(TYP)
36
38L
38U
40
42
44
46L
46R
48L
48R
49
50
52
53
54
56
58
60
62
64
66
68
70
72
74a
74b
76a
76b
78
80
82
84
86
88(TYP)
90(TYP)
92
94
96
126

DEVICE USING A PNEUMATICALLY-ACTUATED CARRIER TO EJECT PROJECTILES ALONG A TRAJECTORY

FIELD OF THE INVENTION

This invention relates generally to pneumatic devices for firing a projectile, and more specifically, to a pneumatic device that discharges compressed air behind a projectile to accelerate the projectile down and out of a barrel.

BACKGROUND OF THE INVENTION

Pneumatic or pressurized gas-actuated devices for firing various shaped and sized projectiles are known in the art. These devices are commonly used to propel appropriate sports balls in practice activities for various sports, such as baseball and tennis, although a more common mechanism for propelling practice balls employs friction between a ball and a rotating wheel. Other pneumatic projectile firing devices have been developed for sports such as paintball, where participants engage in mock battles and fire pellets of colored liquid at one another. Still other pneumatic devices, such as B-B guns or pellet guns, are designed for firing small caliber projectiles for target shooting or small game hunting. A very wide variety of different-sized projectiles can be fired with a pneumatic device, and in each of these prior art devices, the projectile being propelled through a barrel is sized to maintain a relatively close fit between the projectile and the bore of the barrel to minimize loss of pressure and reduced efficiency.

A common characteristic of these prior art pneumatic devices is that the size or caliber of the projectile that is pneumatically propelled is thus directly linked to the diameter of the barrel of the device. Consequently, only one size or caliber of projectile can be used with a particular barrel. A tennis ball can therefore not be used with a prior art pneumatic pitching machine that is designed to propel a softball because the sizes of the two different types of ball are so disparate. Furthermore, a projectile that is substantially smaller in diameter than the barrel can randomly strike the sides of the barrel while being accelerated, which will likely adversely affect the accuracy of the projectile's accuracy and may result in damage to the barrel or to the projectile.

An apparent solution to the problem of propelling different diameter projectiles with the same pneumatic device is to provide interchangeable barrels of corresponding different diameters, so that more than one size of projectile can be fired by the same device. However, this solution is not entirely satisfactory, because the barrel of a pneumatic device represents a significant portion of the entire device, and changing barrels is not such a simple task as to be convenient. It would be desirable to develop a device that is capable of firing more than one size of projectile using a single barrel, and without causing damage to the barrel or reducing the accuracy of the projectile's aim.

As mentioned above, prior art pneumatic devices have been used to propel balls with a desired trajectory and velocity for practice activities relating to such sports as baseball and tennis. For example, U.S. Pat. Nos. 4,524,749; 4,834,060; 4,995,371; and 5,121,735 disclose automatic pitching devices that forcibly eject baseballs to enable a person to practice batting the ejected baseballs. Such devices require a barrel specifically designed for a single type of ball, either a baseball, a softball, or a practice ball. A practice ball is the same general size and weight as a baseball, but lacks the stitched seams of a baseball. Some prior art pitching machines, particularly non-pneumatic pitching machines that propel a ball using one or more rotating wheels, do not function well with actual baseballs, because the stitching orientation can change randomly from one ball to the next. The pitching machine wheels may engage the balls differently on successive pitches, adversely affecting the accuracy of successive pitches. Thus practice balls have been developed for use with such devices. In the prior art, a separate device, or at least a separate barrel, has been required for projecting tennis balls, baseballs, and practice balls, even though the relative sizes (diameters) of all three types are similar.

While many of the prior art devices, including non-pneumatic devices, for imparting a desired trajectory to a spoils ball function in a generally satisfactory manner for a particular type of ball, room for improvement in the art still exists. It would be desirable to develop a device for use in pitching balls that has certain desirable features, such as a size and weight sufficiently limited so the device is readily portable and can be transported and set up by a single person, using a portable power source. This device should also have a relatively low cost and should incorporate certain safety features. For example, an enclosure should be provided for moving parts to prevent accidental injury to fingers that might otherwise be caught in the mechanism. A lockout mechanism should be included to prevent a projectile from being fired if an object or individual is blocking the mouth of the barrel. An audible/visual warning should be provided just prior to a projectile being launched. Further desirable features for this type of device, which will appeal to baseball players in particular, would be a display of ball speed, and the ability to deliver projectiles with relatively high accuracy and consistency, in a relatively fast cycle. It would be further desirable to develop a device that is capable of firing objects that are irregular in shape and do not closely conform to a cross-sectional shape of a barrel.

SUMMARY OF THE INVENTION

In accord with the present invention, a device is defined for ejecting a projectile from a barrel using a projectile carrier that when acted upon by a charge of compressed fluid, propels the projectile through the barrel. The barrel defines an inner space and has an open end and a closed end. The projectile carrier is disposed at a firing position within the barrel, generally adjacent to the closed end and is sized to move freely within the barrel. When acted upon by the charge of compressed fluid, the projectile carrier transfers kinetic energy to a projectile and ejects the projectile from the barrel along the desired trajectory.

Preferably, the barrel is of sufficient length so that as the pressure within the barrel drops to a level below ambient air pressure due to the forward motion of the projectile carrier through the barrel, the projectile carrier is prevented from being ejected from the open end of the barrel.

The device also includes a chamber that holds the charge of compressed fluid and a valve that controls the release of the charge of compressed fluid into the barrel behind the projectile carrier. The chamber is coupled in fluid communication with the inner space of the barrel through the valve. When the valve opens, the pressure of the compressed fluid imparts kinetic energy to the projectile carrier. The pressure of the charge of compressed fluid in the chamber is selectively variable, and the velocity of the projectile can be controlled as a function of the pressure in the chamber. The valve is electromagnetically actuated.

In one preferred embodiment, the device includes a rechargeable battery. Further, an external power source or the battery can be selectively chosen to provide an electrical current to energize the device.

A microprocessor is preferably included in a controller to determine a magnitude of pressure developed in the chamber, and thus to achieve a desired velocity. The microprocessor is electrically coupled to the compressor, the valve, a display, and a control panel and implements a firing sequence. The microprocessor prevents the device from being operated until a correct password has been entered into the control panel.

An optical sensor disposed adjacent to the open end of the barrel is electrically coupled to the microprocessor. The optical sensor detects the ejection of a projectile from the barrel, and the microprocessor determines the velocity of the projectile and indicates the velocity on the display. Preferably, the microprocessor prevents the release of the charge of compressed fluid if the optical sensor indicates the presence of an object at the open end of the barrel, thereby preventing a projectile from being ejected when the open end of the barrel is obstructed. Furthermore, the microprocessor initiates a firing sequence when the optical sensor detects a projectile being loaded into the open end of the barrel.

A key feature of the device is the projectile carrier. Preferably, the projectile carrier includes a surface shaped to center the projectile within the barrel during the acceleration of the projectile through the barrel, thereby minimizing random contacts between the projectile and the interior surface of the barrel. This surface is shaped to accommodate different size projectiles, so that the different size projectiles can be ejected using the same barrel.

Another aspect of the present invention is directed to a method that includes steps generally consistent with the description of the apparatus set forth above.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

A preferred embodiment of the present invention is designed to use a charge of compressed air to repeatedly throw or project a baseball or other preferably spherical-shaped projectile along a defined trajectory. Unlike the prior art pneumatic devices for throwing balls, the present invention is able to throw various size (e.g., various diameter) projectiles from a single barrel. It achieves this result by providing a design in which the force developed by the pressurized air is not applied to the projectile, but is instead applied to a lightweight intermediary object having a consistent, defined diameter that is slightly less than that of the barrel. The pneumatic pressure drives the intermediary object down the barrel, and the intermediary object, which is captive within the barrel, drives the projectile or ball with consistent efficiency. Consequently, most of the pneumatic pressure in a compressed air charge is applied to accelerate the projectile.

Various-sized projectiles (sufficiently small to fit within the barrel) can be driven by the intermediary object. In the preferred embodiment, the intermediary object is shaped to maintain spherical projectiles centered within the barrel and away from the sides of the barrel during their acceleration, so that even projectiles sized substantially smaller than barrel do not strike the sides of the barrel while being launched. Thus, projectiles of varying sizes can be accurately fired by the present invention without damaging the barrel or requiring a change in the size of the barrel.

A typical application of the present invention is directed to pitching a baseball or serving a tennis ball to respectively enable batting practice or practice of tennis strokes. However, the present invention is not in any way limited to this application and can also be used for pitching baseballs for fielding practice, pitching perforated plastic WHIFFLE™ balls for indoor batting practice, and can project many other types of projectiles, including those that are non-spherical. A preferred embodiment is implemented as a battery powered portable device that is readily hand carried to a desired field location and can be setup for use within minutes. Further details of this preferred embodiment are as follows.

Figure 1:
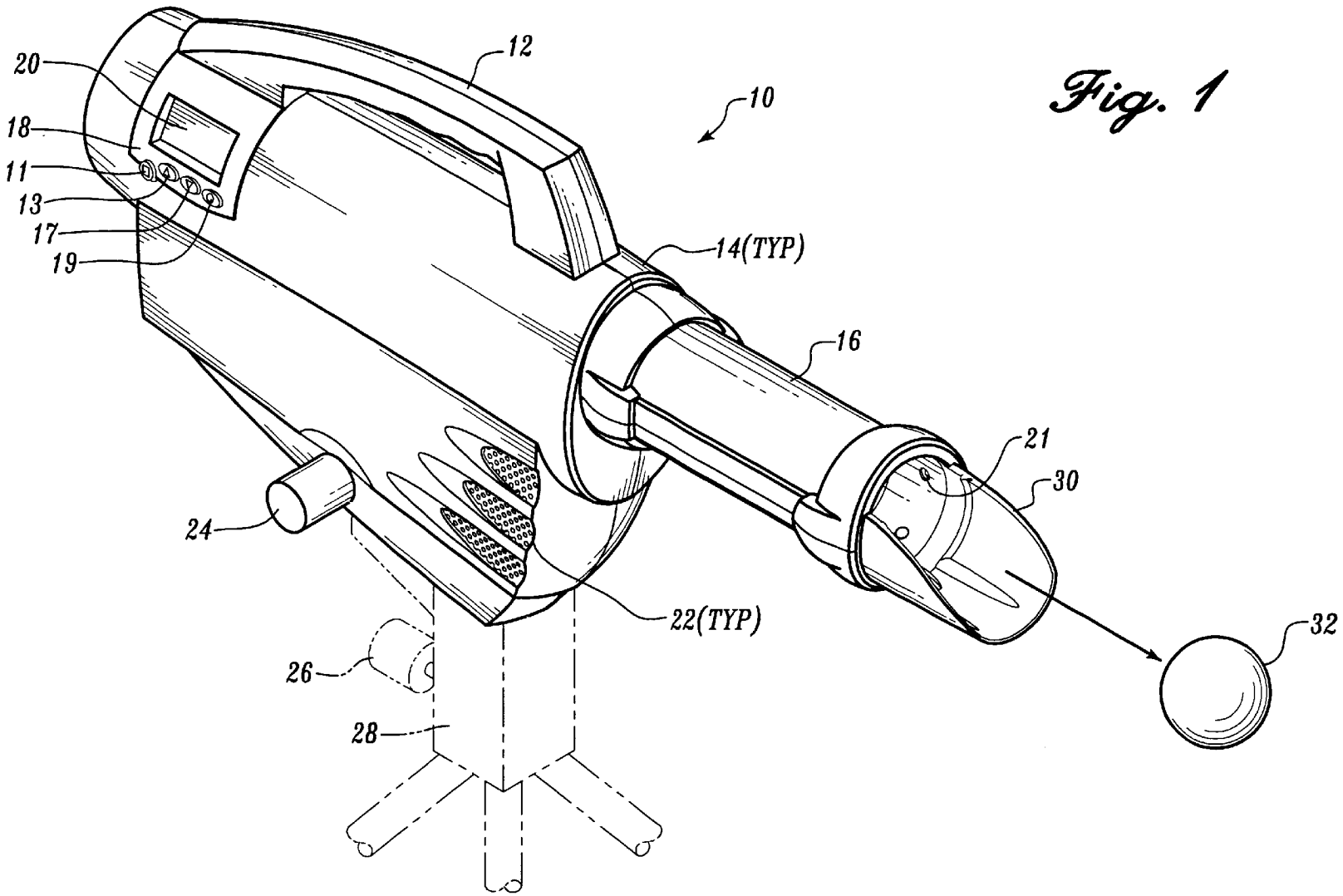
FIG. 1 is an isometric view of a pneumatic device in accord with a preferred embodiment of the present invention.

With reference to FIG. 1, a pneumatic device 10 is shown in accord with the present invention. For the purposes of the following discussion, the path of the projectile shown by the arrow in FIG. 1 determines the orientation of the pneumatic device in regard to the terms "forward," "front," "rear," "left," and "right." "Forward" refers to the direction in which the projectile is moving as it accelerates along the path; "front" refers to the portion of pneumatic device 10 that is closest to the path of the projectile as it exits the pneumatic device, and "rear" refers to the portion of the device furthest from the projectile as it exits the pneumatic device. "Right" and "left" reference the point of view of an operator standing at the rear of the pneumatic device and facing forward. Thus, "left" refers to the side of the pneumatic device to the left of the operator, and "right" refers to the side to the right of the operator.

A housing 14 surrounds and substantially encloses the internal components of pneumatic device 10, so that the operator is protected from any injury that might occur due to contact of fingers or hands with the internal components. A carrying handle 12 is provided along the top of housing 14. Preferably, housing 14 is fabricated from an injection-molded plastic that is sufficiently strong and impact resistant to withstand impacts from ricocheting projectiles. Housing 14 includes a control panel 18 and a display panel 20. Control panel 18 includes an ON/OFF-button 11, an UP-button 13, a DOWN-button 17, and an ENTER-button 19. Preferably display panel 20 is a liquid crystal display (LCD), although other types of displays can instead be used, such as one employing light emitting diodes (LEDs). Housing 14 also includes vents 22, which are decorative, but also allow air to circulate through the housing to cool the internal components. A barrel 16 extends from the front of housing 14. An elastomeric guard 30, which serves several functions, is disposed at the front end of barrel 16. Elastomeric guard 30 provides some protection against injury that might otherwise be caused by impacting the end of barrel 16 and also, serves as a supporting surface when loading balls or other projectiles into the open front end of barrel 16.

Also shown in FIG. 1 is a ball 32 that has been forcibly ejected or pitched from pneumatic device 10. Since this embodiment of the present invention is likely to be used for pitching baseballs or "serving" tennis balls, barrel 16 has a diameter that is larger than that of either a baseball or tennis ball. It should be recognized however, that pneumatic device 10 can also be used for propelling other types of projectiles. Unlike prior art devices that have been unable to use the same barrel for both baseballs and tennis balls, the present invention allows a single barrel size to be used to propel projectiles, which are different in size. While it is theoretically possible that in the present invention, a single size barrel of sufficiently large diameter could be used to propel projectiles ranging in size from a basketball to a golf ball, the efficiency of the device for propelling the smaller projectiles would likely be unacceptable, as will be apparent from the discussion that follows. Preferably, the sizes of the different types of projectiles propelled from a single size barrel by pneumatic device 10 should not vary across such a wide range. However, with respect to baseballs and tennis balls, the relative sizes of these projectiles are sufficiently close so that the efficiency of pneumatic device 10 is acceptable for each type of ball.

Incorporated into the mouth of barrel 16 is an optical sensor system 21. The optical sensor system is used to measure the velocity of ball 32 as it leaves the barrel, to initiate the firing cycle of pneumatic device 10 by detecting when a projectile has been loaded into barrel 16, and to prevent pneumatic device 10 from firing when there is an obstruction in the mouth of barrel 16. Further details of optical sensor system 21 are described below.

A tilt adjustment knob 24 is tightened once the vertical angle of barrel 16 relative to the horizontal plane has been adjusted as desired, so that the trajectory of the projectile can be controlled. Shown in phantom view is a tripod 28 and a pan adjustment knob 26. It is expected that pneumatic device 10 will be used in conjunction with a portable support structure such as tripod 28. Pan adjustment knob 26 is tightened after the horizontal trajectory of the projectile has been adjusted as desired by rotating pneumatic device 10 around the vertical axis of tripod 28. In this preferred embodiment, the angular elevation of barrel 16 can be adjusted from about 0° to about 80° degrees, with a free play of less than 1°, while the angular pan position in the horizontal plane is fully adjustable throughout 360° at about 1° increments, with a free play of less than ½°.

Figure 2:
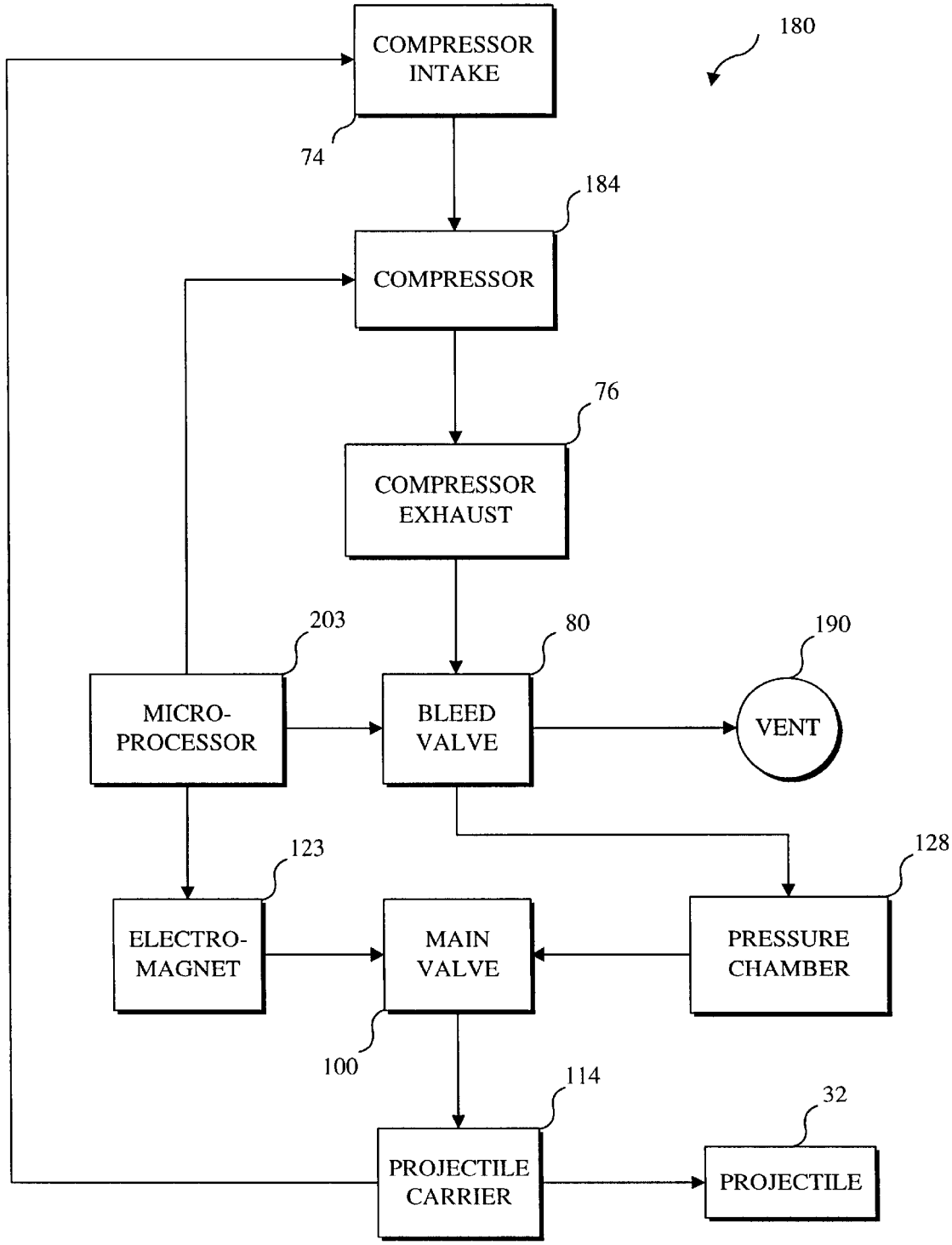
FIG. 2 is a block diagram illustrating the functional relationships among major components of the pneumatic device.
Figure 3:
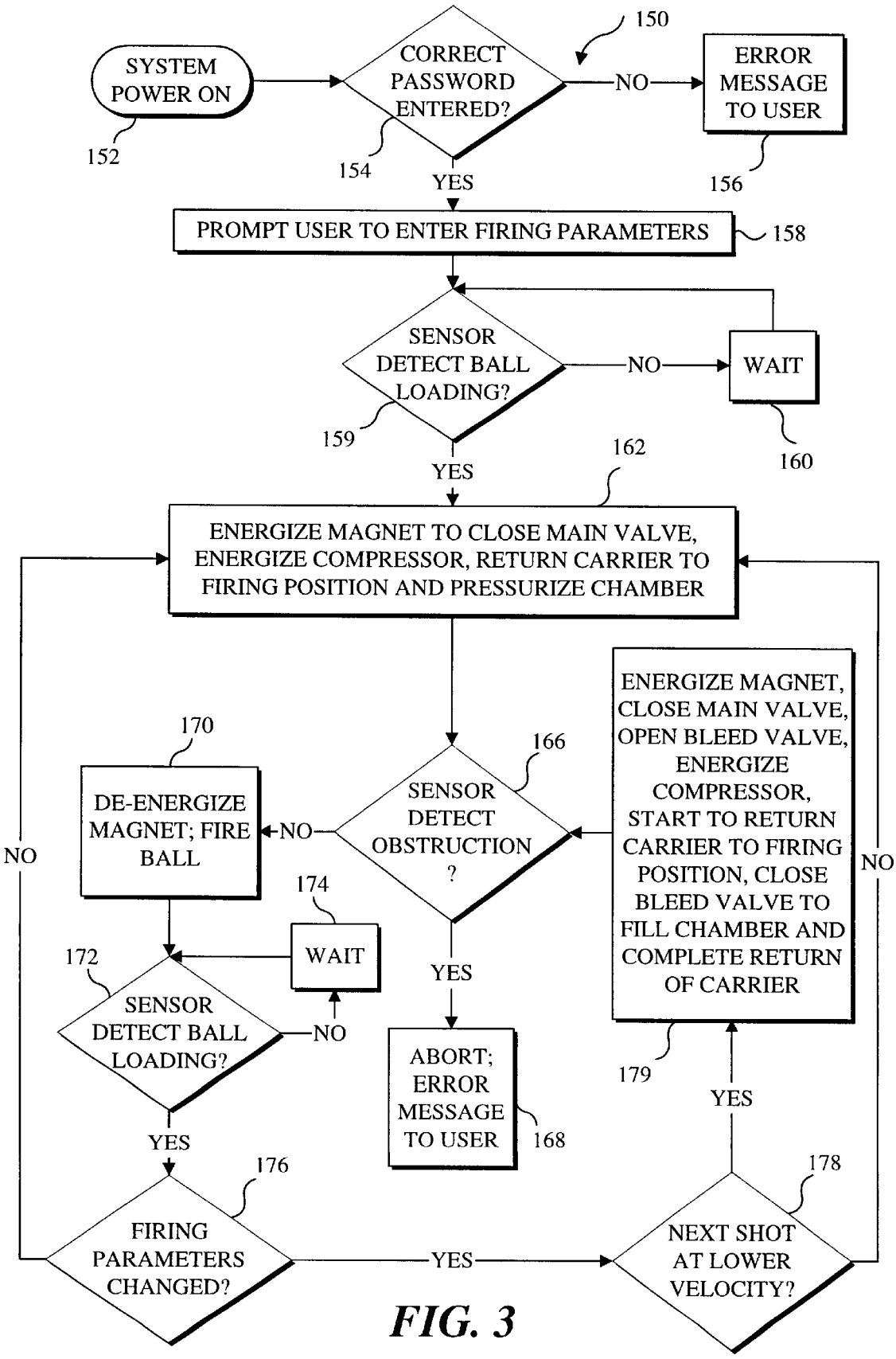
FIG. 3 is a flow chart illustrating the logical steps implemented by the microprocessor of the pneumatic device of FIG. 1 to control the firing cycle.

Before discussing the detailed structure of the preferred embodiment, it will be helpful to examine the functional relationships of the components of pneumatic device 10, and also the logic used to control pneumatic device 10. FIG. 2 illustrates the functional relationships of the components in a block diagram 180, and FIG. 3 illustrates a flowchart 150 disclosing the logical steps employed to control the firing cycle of the pneumatic device.

In the following description of FIG. 2, the reference numbers used for components shown in subsequent, more detailed drawings are applied to each functional block of the figure. An air compressor intake port 74 is disposed within barrel 16 immediately behind a projectile carrier 114. Compressor intake port 74 provides fluid communication between the intake of compressor 184 and a volume 130 (not shown in FIG. 2) within barrel 16, behind projectile carrier 114. The withdrawal of air from this volume through compressor intake port 74 when compressor 184 is energized acts on projectile carrier 114, causing it to be returned to its firing position. Compressor 184 is also in fluid communication with a compressor exhaust port 76, which in turn is in fluid communication with a bleed valve 80. When open, bleed valve 80 vents the compressor exhaust to atmosphere, as indicated by a block 190, and when closed, enables the compressor exhaust to fill a pressure chamber 128. It should be noted that the velocity of the projectile will be dependent upon the magnitude of the pneumatic pressure developed in pressure chamber 128 at the time of the firing, a greater pressure generally resulting in a higher velocity.

A microprocessor 203 is electrically coupled to compressor 184, bleed valve 80, and an electromagnet 123. As described in detail below, when the firing cycle is initiated, microprocessor 203 energizes compressor 184 to begin pressurizing pressure chamber 128. Microprocessor 203 controls the velocity of the projectile by controlling the length of time that the exhaust or output of compressor 184 is directed into pressure chamber 128 (and is not being vented through bleed valve 80). It should be noted that compressor 184 serves two functions. The intake of compressor 184 creates a partial vacuum in barrel 16 so that atmospheric pressure forces the return of projectile carrier 114 to the firing position, and the exhaust of compressor 184 fills pressure chamber 128. The length of time that compressor 184 needs to operate to return projectile carrier 114 to the firing position is not always equal to that required to achieve the magnitude of pressure within pressure chamber 128 needed to achieve the desired velocity of the projectile about to be fired.

Microprocessor 203 is programmed to recognize that when the velocity selected for the next shot is substantially less than the velocity of the last shot, it is likely that more time will be required to return the projectile carrier to its firing position than is required to fill pressure chamber 128 with the required charge of compressed air. Under this condition, microprocessor 203 will determine the length of time that compressor 184 is required to operate to return projectile carrier 114 to the firing position (which is a function of the length of the barrel and the draw of the compressor) and the time required to fill pressure chamber 128 with the required amount of compressed air. Microprocessor 203 will then open bleed valve 80 (so that compressor exhaust 76 is venting to atmosphere as per block 190) and energize compressor 184 for a first time interval. The first time interval is equal to the difference between the time required to return the projectile carrier to its firing position and the time required to fill pressure chamber 128. After the first time interval has passed, microprocessor 203 will cause bleed valve 80 to close and then will continue to operate compressor 184 for a second time interval, which equals the time required to fill pressure chamber 128 to the desired magnitude of pneumatic pressure. During this second time interval, compressor 184 is simultaneously returning projectile carrier 114 to its firing position and filling pressure chamber 128.

Pressure chamber 128 is in fluid connection with a main valve 100. When held closed by electromagnet 123, main valve 100 seals pressure chamber 128. When microprocessor 203 de-energizes electromagnet 123, main valve 100 opens, and the pressurized air from pressure chamber 128 flow through main valve 100 and acts on projectile carrier 114. Projectile (ball) 32 is seated within projectile carrier 114, and as the pressurized air from pressure chamber 128 causes projectile carrier 114 to accelerate down barrel 16, projectile carrier 114 also moves projectile or ball 32 so that it likewise accelerates down the barrel.

It should be noted that while the preferred embodiment of the invention includes a compressor that pressurizes an internal chamber, it is contemplated that other sources can be used to provide a charge of compressed air or pressurized fluid to propel the projectile carrier. Thus, an external compressor could be used instead of the internal compressor disclosed above. Furthermore, the charge of compressed air could be developed by the combustion of an combustible fluid, such as propane mixed with air, within a confined volume or internal chamber (not shown).

FIG. 3 illustrates the logic used by microprocessor 203 to control the firing cycle of pneumatic device 10. At a block 152 the power for pneumatic device 10 is turned on using ON/OFF-button 11 from control panel 18. The logic then proceeds to a block 154, in which the logic determines if the operator has entered the correct four-digit password. This password is required as a safety feature, since failure to enter the password precludes unauthorized use of pneumatic device 10, e.g., by young children. It should be apparent that a device useful for duplicating baseball pitches and tennis serves can also be potentially harmful to individuals and property if used improperly or in an unsafe manner. The operator enters the password using UP-button 13 and DOWN-button 17 from control panel 18 to respectively increase or decrease a two-digit displayed number from 00–99, and then taps ENTER-button 19 to accept the displayed entry, repeating this process until all digits of the password have been entered. If the password is incorrect, the logic proceeds to a block 156, which provides for displaying an error message to the operator. If the password is correctly entered, the logic proceeds to a block 158 and microprocessor 203 prompts the operator to enter firing parameters, including the desired velocity of the ball. The operator can respectively increase or decrease the velocity of the ball by using UP-button 13 or DOWN-button 17. Control panel 18 can also be used to navigate through a menu to enable the operator to select from a plurality of pre-programmed firing parameters stored by microprocessor 203, or to select functions such as the use of a randomly varying velocity between defined minimum and maximum velocities for successive balls. While the preferred embodiment discussed herein does not include any actuator driven control of elevation and pan angles, it will be apparent that motor drives or other types of actuators can be coupled to pneumatic device 10 to achieve desired settings for both of these parameters, thereby enabling a user to specify all aspects of the trajectory of the ball or other projectile. These and other parameters are implemented under the control of the microprocessor.

Once the parameters are entered, the logic proceeds to a decision block 159 and microprocessor 203 determines if a ball has been loaded into the barrel. In the preferred embodiment, optical sensor system 21 is disposed at the front opening of barrel 16, where it detects the loading of a ball. The projectiles (such as ball 32) are both loaded and ejected through the front of barrel 16. If the response to this query is negative, the logic proceeds to a block 160, and pneumatic device 10 essentially waits until a ball is loaded. Once optical sensor system 21 has detected a ball being loaded, the logic proceeds to a block 162, in which microprocessor 203 energizes electromagnet 123 to close main valve 100 and thereby seals pressure chamber 128. Microprocessor 203 continues to energize electromagnet 123 until the main valve must be opened to complete firing sequence. After a brief pause to ensure that main valve 100 is closed, microprocessor 203 energizes compressor 184. The intake port for compressor 184 is within barrel 16, immediately behind projectile carrier 114. Thus, as compressor 184 begins operating and filling pressure chamber 128 with compressed air to achieve the pressure required to fire ball 32 at the desired velocity, projectile carrier 114 is forced back into its firing position in response to the partial vacuum caused by compressor 184 withdrawing air from the volume disposed behind the projectile carrier, i.e., ambient air pressure forces the projectile carrier back down the barrel. This arrangement ensures that projectile carrier 114 is disposed in the proper firing position (fully back down barrel 16) before the main valve is opened. Microprocessor 203 controls the length of time compressor 184 operates in response to the desired velocity for the ball that was selected by the operator. The higher the desired velocity, the greater the magnitude of the pneumatic pressure within pressure chamber 128 required to achieve that desired velocity. Compressor 184 is shut down to conserve battery power once the desired pneumatic pressure has been stored in pressure chamber 128.

Once pressure chamber 128 has been pressurized to the required pneumatic pressure, the logic proceeds to a decision block 166 in which microprocessor 203 determines if optical sensor system 21 has detected an obstruction at the mouth of barrel 16. If the sensor detects an obstruction, such as a jammed ball, operator's hand, or other object, the logic proceeds to a block 168, the firing sequence is aborted, and an error message is displayed to the operator.

If, at decision block 166, the sensor does not detect an obstruction, the logic proceeds to a block 170, in which microprocessor 203 de-energizes electromagnet 123. With electromagnet 123 no longer holding main valve 100 closed, the pressure of the compressed air in pressure chamber 128 forces the main valve open. The compressed air within the pressure chamber passes through the open main valve and enters barrel 16 immediately behind projectile carrier 114. This charge of compressed air forces projectile carrier 114 and the ball or other projectile that was just loaded into barrel 16 to accelerate toward the mouth of the barrel. The projectile carrier has a relatively low mass and slows as it proceeds down the barrel as the pressure of the expanding compressed air behind it decreases. At some point before the projectile carrier reaches the mouth of the barrel, the pressure behind the projectile carrier becomes substantially less than ambient pressure. Preferably, the length of barrel 16 is selected to be sufficient so that projectile carrier 114 stops and is not ejected from the barrel, even when the operator selects the highest available projectile velocity setting. Because the ball (or other projectile) is smaller than the barrel, a partial vacuum does not develop behind the ball (or other projectile) as it continues out the mouth of the barrel and follows its intended trajectory.

After the projectile has been fired in block 170, the logic advances to a decision block 172, in which microprocessor 203 determines if optical sensor system 21 has detected the loading of another ball. If no other ball has been loaded, the logic proceeds to a block 174 and pneumatic device 10 enters a waiting mode until a ball is loaded (or until the pneumatic device is de-energized). Once optical sensor system 21 has detected a ball being loaded, the logic proceeds to a decision block 176 in which microprocessor 203 determines if the firing parameters for the current ball or other projectile that was just loaded have been changed with respect to the last ball or projectile that was fired. The firing parameters may have been changed in one of two ways. In block 158, the operator may have used control panel 18 to select from a plurality of pre-programmed firing parameters stored by microprocessor 203 that would cause the velocity of successive balls to be different, or the operator may have used UP-button 13 or DOWN-button 17 to respectively increase or decrease the desired velocity of the currently loaded ball. Note that by using UP-button 13 or DOWN-button 17 the operator can override any previously selected pre-programmed firing parameters. Similarly, the operator can use control panel 18 to select a pre-programmed firing parameter routine different than the one previously selected. Thus, in decision block 176, microprocessor 203 determines what the velocity of the newly loaded ball should be, based on one of the following: (1) the velocity of the previous ball as originally selected in block 158; (2) a new velocity selected by the operator using UP-button 13 or DOWN-button 17; (3) a new velocity as required by a pre-programmed firing sequence originally selected by the operator in block 158; (4) a new velocity as required by a randomizing function originally selected by the operator in block 158; or (5) a new velocity as required by a newly selected pre-programmed firing sequence.

If, in decision block 176, microprocessor 203 determines that the velocity of the newly loaded ball is not changed, then the logic returns to block 162 and the above-described firing sequence is repeated. Conversely, if in decision block 176, microprocessor 203 determines that the velocity of the newly loaded ball is changed with respect to the velocity of the previously fired ball, the logic proceeds to a decision block 178 in which microprocessor 203 determines if the new velocity is substantially lower than the old or previously used velocity. If the new velocity is not substantially lower than the previous velocity, the logic proceeds to block 162, and the above-described firing sequence is repeated.

If, in decision block 178, microprocessor 203 determines the new velocity is substantially lower than the previous velocity, the logic proceeds to a block 179, in which microprocessor 203 energizes electromagnet 123 to close main valve 100 and seal pressure chamber 128, opens bleed valve 80, energizes compressor 184 to begin to return projectile carrier 114 to the firing position, closes bleed valve 80, and pressurizes pressure chamber 128 to the proper pressure for the desired velocity. As noted above, the purpose of the opening of bleed valve 80 is to prevent pressure chamber 128 from being over pressurized while the projectile carrier is being drawn back to its firing position near the base of barrel 16. When the desired velocity of the next projectile is lower than the velocity at which the last projectile was fired, it is likely that the time interval during which compressor 184 must operate to return projectile carrier 114 to the firing position will be longer than the time interval that compressor 184 must operate for to fill pressure chamber 184 with compressed air at the required pressure. Continuing to operate compressor 184 to fully return projectile carrier 114 to its firing position would thus result in the over pressurization of pressure chamber 128. When bleed valve 80 is open, compressor exhaust 76 is vented to the atmosphere, but the intake is still creating a partial vacuum behind the projectile carrier that draws it back down the barrel. Based on the length of barrel 16 and the draw of compressor 184, microprocessor 203 will be able to determine the length of time that compressor 184 needs to operate to return projectile carrier 114 to its firing position. Microprocessor 203 will also be able to determine the length of time that compressor 184 needs to operate with bleed valve 80 in the closed position to build up the required charge of compressed air in pressure chamber 128. When the time that compressor 184 needs to operate to return projectile carrier 114 exceeds the time that compressor 184 needs to operate with bleed valve 80 in the closed position to pressurize chamber 128, microprocessor 203 will cause bleed valve 80 to open and remain open for the difference between the two times. After the difference between the times has elapsed, projectile carrier 114 will be partially returned to the firing position, and no pressure will have been built up in pressure chamber 128. At that point, microprocessor 203 will close bleed valve 80, so that as compressor 184 continues to operate, pressure chamber 128 is brought to the desired pressure and projectile carrier 114 is fully returned to the firing position. Microprocessor 203 then de-energizes compressor 184. At that point, the logic returns to decision block 166, and the firing cycle repeats if no obstruction is sensed at the mouth of the barrel. It should be noted that when bleed valve 80 is in the open position, compressor 184 is not yet pressurizing pressure chamber 128, and thus the load on compressor 184 is relatively low, and little power from internal battery 36 is required to run the compressor.

Once the programmed firing parameters have been completed, or at any time during the firing cycle, the operator can turn off the pneumatic device. Pneumatic device 10 is shut down using ON/OFF-button 11 on control panel 18. When ON/OFF-button 11 is used to shut down the device, microprocessor 203 opens bleed valve 80 to vent any stored compressed air in pressure chamber 128 to atmosphere, so that when pneumatic device 10 is completely de-energized, there will be no stored pressure that might accidentally discharge a projectile. 203 After allowing enough time to pass to depressurize pressure chamber 128, microprocessor 203 de-energizes electromagnet 123, and the circuit shuts down. This safety feature prevents any loaded projectile from being fired when pneumatic device 10 is de-energized. Preferably, if microprocessor 203 determines that no projectiles have been fired in a ten-minute period, then microprocessor 203 automatically de-energizes the pneumatic device according to the above procedure, to conserve battery power.

Figure 4:
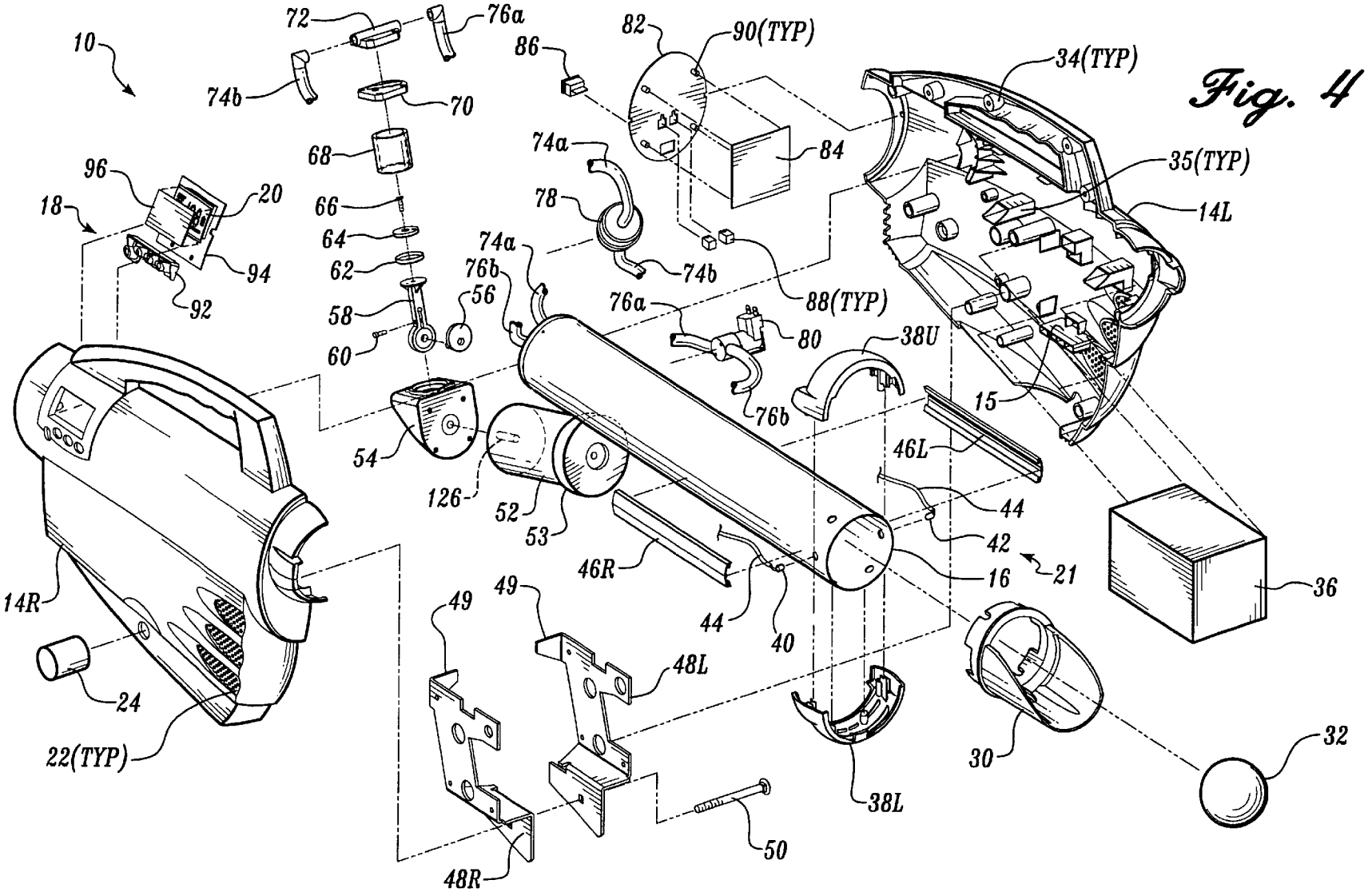
FIG. 4 is a partially exploded isometric view of the preferred embodiment of FIG. 1.

The remaining Figures illustrate mechanical details of a preferred embodiment of the present invention. FIG. 4 illustrates the components comprising pneumatic device 10 in an exploded view. As shown, housing 14 preferably includes a left housing shell 14L and a right housing shell 14R. Incorporated into these left and right housing shells are fastener holes 34, which allow removable fasteners to be used to secure left housing shell 14L to right housing shell 14R. Also included on the interior surfaces of left and right housing shells 14L and 14R are a plurality of chassis projections 35, which abut against and extend around specific internal components of pneumatic device 10, securing the components in place. Those of ordinary skill in the art will readily understand that such chassis projections both ease assembly and support these internal components. One such projection formed on left housing shell 14L is a battery support 15. Battery support 15 provides a platform upon which an internal battery 36 rests. While electrical connections are not shown in this Figure, it should be noted that internal battery 36 provides electrical current to energize the electrically powered components of pneumatic device 10, such as display 20, microprocessor 203, electromagnet 123, and compressor 184.

In the preferred embodiment, internal battery 36 is a generally conventional sealed lead acid, rechargeable battery. Other types of rechargeable batteries can also be used. Sealed type lead acid batteries have the advantages of being readily available, of low cost, and having the capacity to undergo continuous discharge and recharge cycles. However, if overcharged, lead acid batteries can generate hydrogen (a very flammable gas) and therefore, housing 14 must have adequate ventilation to prevent a dangerous build up of this gas, which might otherwise explode if ignited by a spark. A conventional lead acid battery suitable for use as internal battery 36 is capable of powering pneumatic device 10 for a minimum of 400 firings of a baseball at a velocity of up to 40 MPH, without recharging. Internal battery 36 can readily be replaced by removing left housing shell 14L (see FIG. 6, which shows pneumatic device 10 with left housing shell 14L removed).

Control panel 18 is mounted to display 20, and a transparent display lens 96 protects display 20 from damaging effects of the environment. Both control panel 18 (via a support 92) and display 20 are electrically coupled to a printed circuit board 94.

To reduce the amount of internal wiring connections required during assembly of pneumatic device 10, most of the electrical components of pneumatic device 10 are mounted to an electronics panel 84. Electronics panel 84 includes microprocessor 203 and other components (not separately shown), including a voltage regulator, a buzzer or other audio transducer to provide audible feedback that a control button has been actuated, battery charging and power supply control circuits, a crystal oscillator for timing control, and an analog-to-digital converter. It is envisioned that it might be useful to include a thermistor on electronics panel 84 as well. A thermistor (not shown) is optionally included to monitor the temperature of compressor 184 to prevent overheating, and also to monitor a condition that affects battery performance. The majority of the electrical connections for pneumatic device 10 are routed to electronics panel 84.

Electronics panel 84 is mounted to a rear plate 82 by standoff fasteners 90, and rear plate 82 is secured in place at the rear end of pneumatic device 10 when left and right housing shells 14L and 14R are assembled to form the overall housing. Rear plate 82 includes two conventional power supply connectors 88, one of which is used to connect to an external power supply such as an external lead acid battery or line powered, direct current (DC) power supply, and the other of which is used to connect to an external DC power source to recharge internal battery 36. A third connector (not shown) may be added to provide power to accessories from the internal battery. It is expected such accessories might include an automatic loader and/or a motorized pan and tilt drive (neither shown).

Rear panel 82 also includes a battery select switch 86, which allows the operator to selectively energize pneumatic device 10 with either internal battery 36, or the external DC power supply (not shown). If no external power supply is connected, selecting the external power source with battery select switch 86 will completely disconnect pneumatic device 10 from internal battery 36, allowing pneumatic device 10 to be stored with no power drain.

FIG. 4 shows how tilt adjust knob 24 is connected to a carriage bolt 50 that passes through a left bracket 48L and a right bracket 48R. These brackets provide internal support for barrel 16 and mount the pneumatic device on tripod 28 (as shown in phantom view in FIG. 3) so that it can be tilted to achieve the desired elevation of the trajectory before tightening tilt adjust knob 24. Preferably left and right brackets 48L and 48R are fabricated from sheet metal, although structural composite or fiber-reinforced plastic material may alternatively be used. Flanges 49 on left and right brackets 48L and 48R abut the rear of barrel 16, transmitting recoil forces acting on barrel 16 to tripod 28.

Also shown in FIG. 4 are details of elastomeric guard 30 and optical sensor system 21. Elastomeric guard 30 is attached to barrel 16 by being captured between the outer surface of the barrel and an upper bracket 38U and a lower bracket 38L. These brackets preferably are formed of injection-molded plastic, although other suitable materials may also be used. The upper and lower brackets also protect and securely mount optical sensor system 21. Optical sensor system 21 includes an optical emitter 40, disposed on the right side of barrel 16, and an optical detector 42, disposed on the left side of barrel 16. Preferably optical emitter 40 is an LED and optical detector 42 is a phototransistor. These components are electrically coupled to microprocessor 203 (which is mounted on electronics panel 84) through leads 44. Leads 44 are disposed on the external surface of barrel 16, and are protected by left and right cover plates 46L and 46R, respectively, along the section of barrel 16 that extends outside of left and right housing shells 14L and 14R.

It should be noted that compressor 184 must be capable of being cycled on and off on a continuing basis for an extended period of time. Light duty compressors, such as those energized by connection to an automotive cigarette lighter receptacle to occasionally inflate an automobile tire in an emergency are not generally capable of the high duty cycle and long life required of compressor 184. Compressor 184 should be able to generate the required pressures in pressure chamber 128 quickly, so that pneumatic device 10 can rapidly fire a series of balls or other projectiles; compressor 184 must produce sufficient pneumatic pressure to propel a baseball at speeds of 50 MPH in five seconds or less, and at speeds of 70 MPH in eight seconds or less. The pressure required by pneumatic device 10 is a function of the desired velocity of the projectile, and can vary from about 5 PSI to about 100 PSI in the present preferred embodiment. However, in a future embodiment that is likely to be used for professional sports practice, the compressor will likely need to generate substantially higher pressures to achieve higher velocities of baseballs and other types of projectiles. Additionally, it is preferred for compressor 184 to draw a relatively modest level of power. In the present preferred embodiment, as noted above, pneumatic device 10 can project more than 400 baseballs at 40 MPH on a single charge of internal battery 36.

The components of compressor 184 include an electric motor 52 coupled to a fan 53, a drive housing 54, an eccentric crank wheel 56, a piston 58, a pin 60, a piston seal ring 62, a piston seal retainer plate 64, a fastener 66, a cylinder 68, a valve plate 70 (which includes two one-way valves—not separately shown), and a manifold head 72. Piston 58 reciprocates up and down within cylinder 68, being driven by eccentric crank wheel 56, which is in turn driven by a shaft 126. The shaft is rotatably driven by electric motor 52. Immediately above cylinder 68 are mounted valve plate 70 and manifold head 72. The two one-way valves in the valve plate enable air to flow into cylinder 68 via an intake line 74*b* when piston 58 is moving downwardly on its intake stroke, block flow from an exhaust line 76*a*, and enable air to flow from the cylinder into exhaust line 76*a* while blocking air flow into intake line 74*b*, when the piston is moving upwardly within the cylinder, on its exhaust stroke. These one-way valves are preferably reed type valves, but other types of one-way valves may alternatively be used.

Compressor intake line 74*a* draws air from inside barrel 16 through a filter 78. Filtered air then passes through intake line 74*b* and into cylinder 66 via one of the one-way valves in valve plate 70. Air under pressure then is forced from compressor 184 through the other one-way valve in valve plate 70 and into exhaust line 76*a*. Line 76*a* leads to electrically actuated bleed valve 80. If bleed valve 80 is shut (as will be the case if the desired velocity of the next projectile is the same or greater than the velocity of the previous projectile, as described with respect to FIG. 3), then the exhaust air from compressor 184 will flow into exhaust line 76*b*, which is connected to pressure chamber 128 (not shown in this Figure, see FIGS. 6–9) at the rear end of barrel 16. Preferably intake lines 74*a* and 74*b* and exhaust lines 76*a* and 76*b* are fabricated from an elastomeric material with metal or plastic fittings provided at the ends of the lines to couple to the components described above. It should be noted that is possible to provide pneumatic pressure to pressure chamber 128 of pneumatic device 10 without using the internal compressor described above. An external compressor or other source of compressed air or other gaseous fluid can alternatively be used.

Figure 5A:
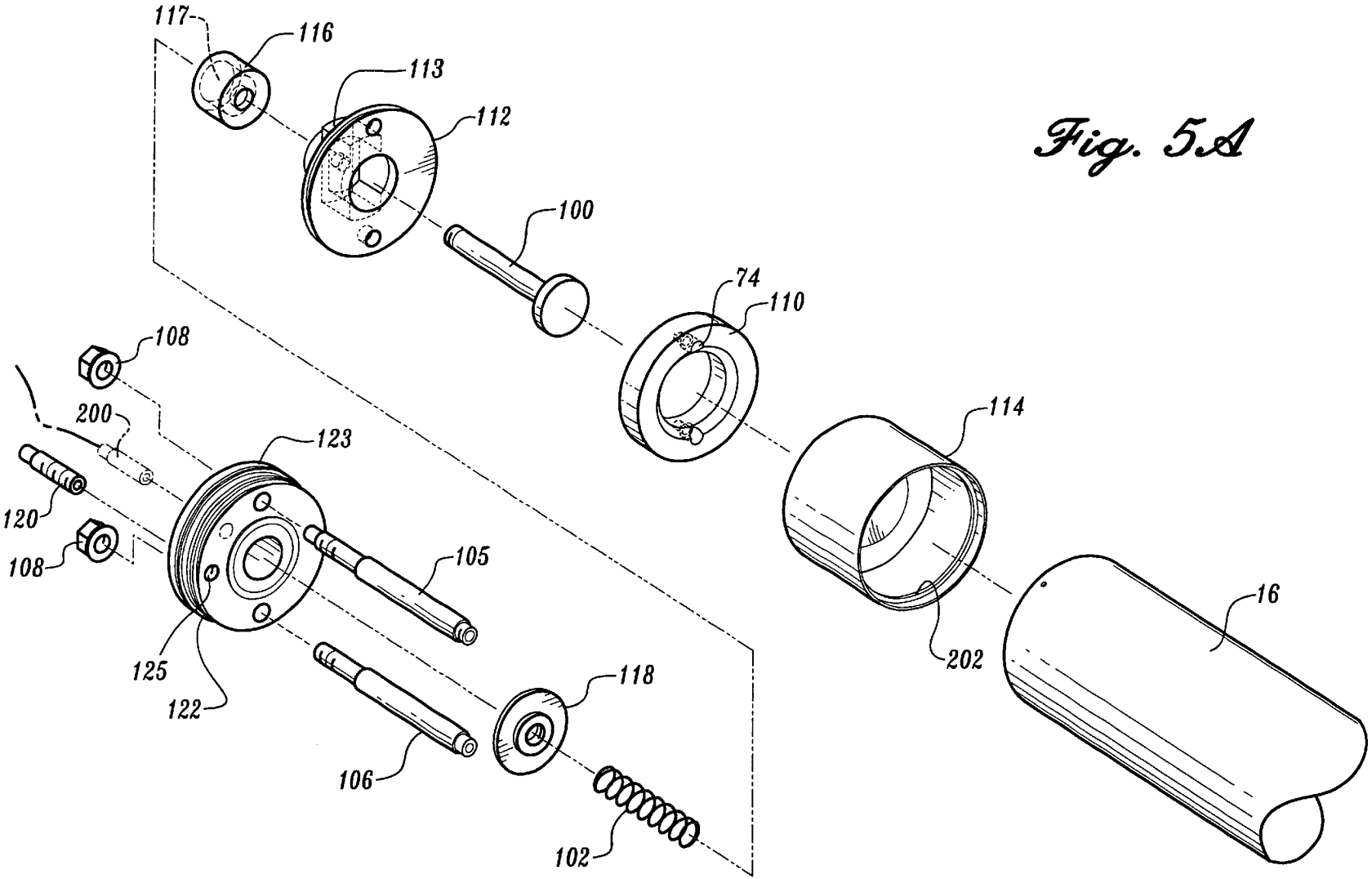
FIG. 5A is a partially exploded isometric view illustrating details of the barrel of the embodiment of FIGS. 1 and 4.

FIG. 5 illustrates the components fitted to the rear end of barrel 16. This section of barrel 16 includes electromagnet 123, pressure chamber 128 (not specifically shown here—see FIG. 7), main valve stem 100, and projectile carrier 114 as discussed above in regard to FIGS. 2 and 3. A barrel end cap 122 forms the rear surface of pressure chamber 128. Electromagnet 123 is wound behind barrel end cap 122, as can be clearly seen in FIGS. 7–9. Air under pressure from compressor 184 is conveyed by exhaust line 76*b* and enters pressure chamber 128 through a pressure fitting 120 that is threaded into a port 125. The rear end of pressure fitting 120 is connected to compressor exhaust line 76*b*, and its front end is threaded into barrel end cap 122, behind port 125. Barrel end cap 122 threads into the rear end of barrel 16, forming a pressure tight seal. A hollow core bolt 105 and a solid core bolt 106 pass through barrel end cap 122 and extend forward through pressure chamber 128. The rear ends of these bolts are secured by nuts 108 at the rear surface of barrel end cap 122, and the front ends of these bolts are threaded into first a pressure chamber front plate 112 and then a spacer ring 110.

Pressure chamber front plate 112 defines the front of pressure chamber 128, while the rear of the pressure chamber is defined by barrel end cap 122, and the sides of pressure chamber 128 is the internal surface of barrel 16, adjacent its rear end. Hollow bolt 105 includes a pressure fitting at its rear end, which is connected to intake line 74*a*. The front end of hollow bolt 105 is connected in fluid communication, through intake port 74, with the volume in barrel 16 that is to the rear of projectile carrier 114 and in front of spacer ring 110. As compressor 184 is energized, a partial vacuum is created in this volume as the air inside the volume is drawn into compressor 184. The partial vacuum thus developed behind the projectile carrier enables the force produced by atmospheric pressure to move the projectile carrier back down barrel 16 to return it to its firing position.

Microprocessor 203 controls the amount of compressed air in pressure chamber 128 by controlling the length of time that compressor 184 operates with bleed valve 80 in the closed position. It is envisioned that a pressure transducer 200 can be incorporated into pressure chamber 128 to provide a confirmation that the desired pressure has been achieved. If not enough compressed air is present within pressure chamber 128, microprocessor 203 can continue to energize compressor 184 until pressure transducer 200 records the correct pressure. If too much compressed air is present within pressure chamber 128, microprocessor 203 can open bleed valve 80 until pressure transducer 200 records the correct pressure. While not required, it is expected that the inclusion of pressure transducer 200 should increase the accuracy of the velocity with which projectiles are propelled using pneumatic device 10. When present, pressure transducer 200 is electrically coupled to microprocessor 203.

Preferably, projectile carrier 114 has a slightly smaller diameter than that of barrel 16, so that a small amount of air can pass between projectile carrier 114 and the sides of barrel 16. If the clearance between projectile carrier 114 and barrel 16 were so tight that no air could pass, then compressor 184 would become starved for air once projectile carrier was seated in its firing position before the desired pneumatic pressure has been achieved in pressure chamber 128. It is contemplated that an alternative embodiment can be constructed in which very little air passes between the outer surface of projectile carrier and the inner surface of barrel 16, such as by using a readily deformable projectile carrier that is slightly larger than the barrel. Such an embodiment would require a bypass valve 204 (see FIG. 6) to provide an alternate inlet for air supplied to compressor 184 once projectile carrier 114 was seated in its firing position.

Figure 5C:
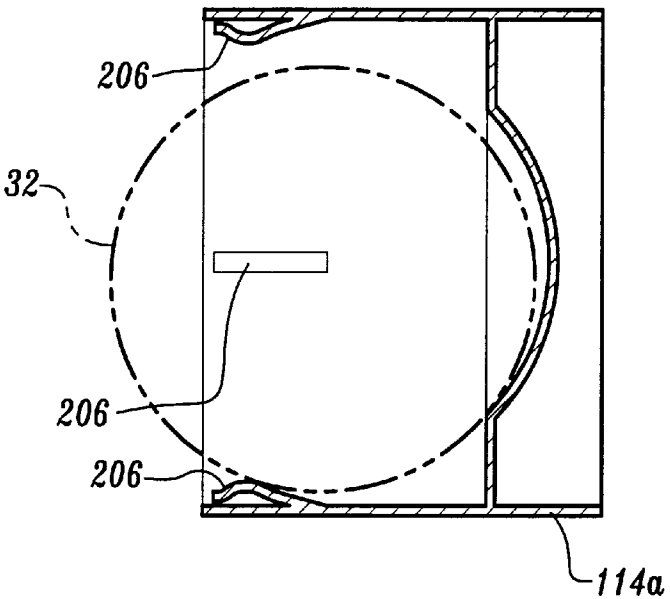
FIGS. 5B and 5C are side elevational views of two embodiments of a projectile carrier for use in the preferred embodiment of the pneumatic device of FIGS. 1 and 4.
Figure 5B:
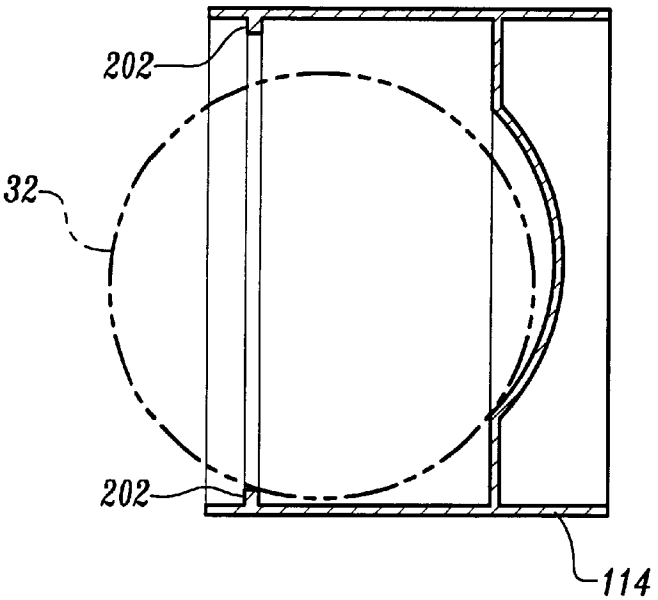

Preferably, projectile carrier 114 includes a raised lip 202, to keep the projectile seated within projectile carrier 114 if pneumatic device 10 is moved or if barrel 16 is aimed at a point below the horizontal (such as to produce a ground ball). The height of raised lip 202 is preferably on the order of 1/16 of an inch, which is sufficient to keep a projectile seated within projectile carrier 114, but not so great as to require much force to be exerted on the projectile during loading to seat the projectile within projectile carrier 114. FIG. 5B provides a detailed view of raised lip 202. It is envisioned that a plurality of spring clips 206, as shown in FIG. 5C, can be molded into (or added as a separate element to) a projectile carrier 114*a* as an alternative to raised lip 202. Spring clips 206 will similarly prevent a projectile from being released from projectile carrier 114*a* until pneumatic device 10 is fired.

Figure 8:
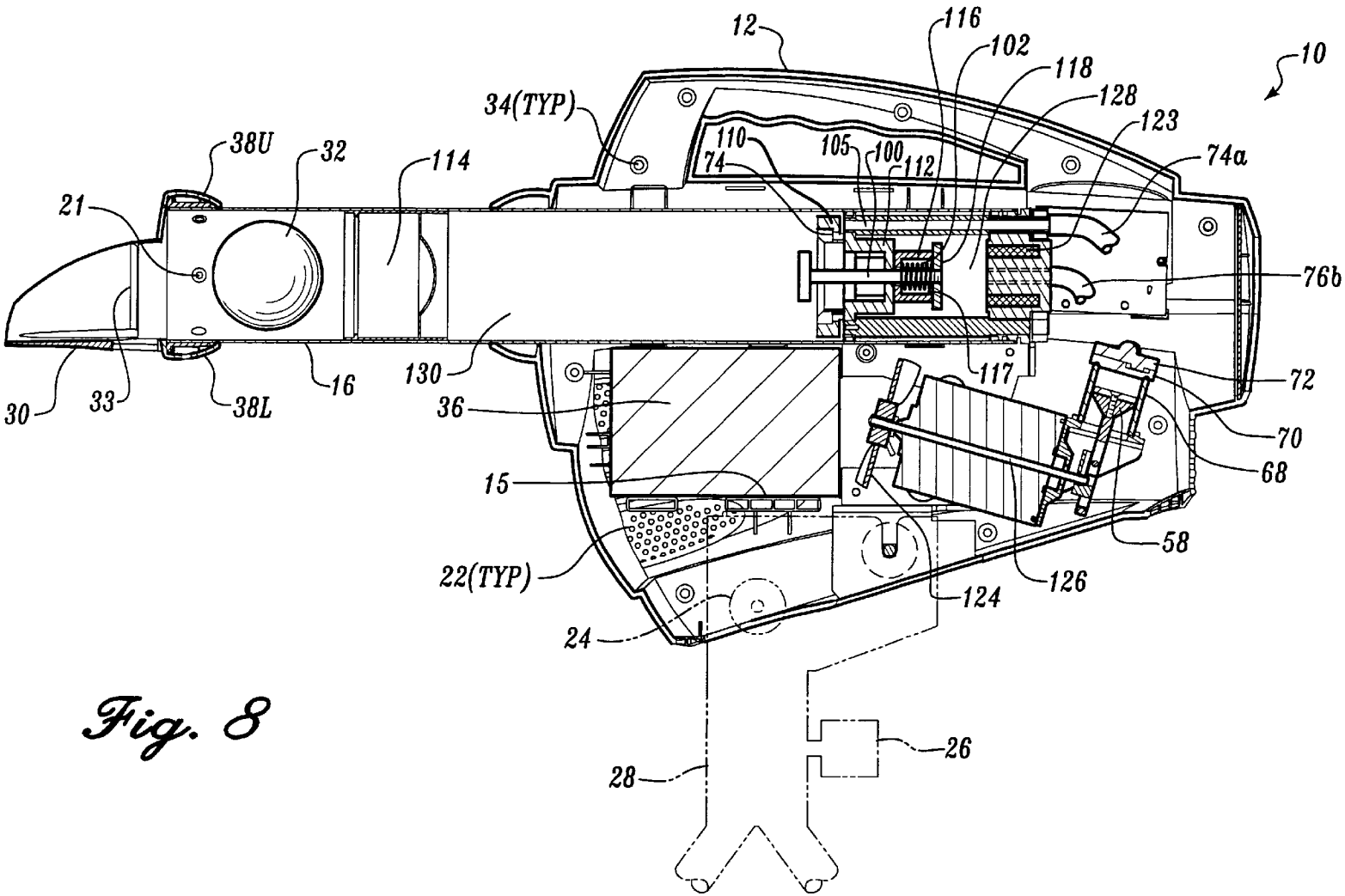
FIG. 8 is a side elevational cross-sectional view of the pneumatic device, showing a ball that is being accelerated down the barrel and is approaching the exit of the barrel of the pneumatic device.

Projectile carrier 114 is disposed in its firing position when it is in contact with spacer ring 110. The purpose of spacer ring 110 is to provide a small clearance distance between main valve stem 100 and projectile carrier 114, to ensure that the head of the main valve stem does not actually impact projectile carrier 114 as main valve stem 100 opens. When closed, the head of main valve stem 100 is seated substantially flush with the front surface of pressure chamber front plate 112. When the main valve is fully open, as is shown in FIG. 8, the head of the main valve stem extends in front of spacer ring 110. By the time the main valve fully opens, projectile carrier 114 is already in motion and is no longer immediately adjacent to spacer ring 110, so that the head of main valve stem 100 never impacts projectile carrier 114. In the preferred embodiment, spacer ring 110 and pressure chamber front plate 112 are individual components. It is contemplated that these two components could alternatively be fabricated as a single unit.

Main valve stem 100 is secured by a bridge 113 (shown in phantom view in FIG. 5, and distinctly in FIGS. 7–9) incorporated on the rear surface of pressure chamber front plate 112. Main valve stem 100 slides back and forth through a guide hole in the center of bridge 113 as the main valve opens and closes. A small bushing (not separately shown) in this guide hole allows main valve stem 100 to move freely while still providing support to keep the main valve stem in proper position. Bridge 113 is specifically configured to allow pneumatic pressure from pressure chamber 128 to be applied to the rear face of main valve 100, so that the main valve opens rapidly when electromagnet 123 is de-energized.

An elastomeric bushing 116 is disposed immediately to the rear of bridge 113. Main valve stem 100 passes through the center of the bushing. Bushing 116 has an internal cavity 117 open toward the rear, into which the front end of a helical spring 102 is seated. The rear end of helical spring 102 is seated on a magnet plate 118. Main valve stem 100 passes through the center of helical spring 102 and is threaded into magnet plate 118. Helical spring 102 exerts a force against magnet plate 118 (and thus on main valve stem 100, which is attached to magnet plate 118), causing the main valve to close and to remain closed so long as pressure chamber 128 has little or no pneumatic pressure in it. In the preferred embodiment, helical spring 102 exerts a force on main valve stem 100 that is equivalent to the force directed in the opposite direction by a pressure of from 4–5 PSI in pressure chamber 128. Thus, main valve stem 100 will remain in its closed position until the pressure in pressure chamber 128 exceeds 4–5 PSI, unless electromagnet 123 is energized.

When electromagnet 123 is energized, magnet plate 118 is held by the electromagnet and main valve stem 100 is retained in its closed position even when the pneumatic pressure in pressure chamber 128 substantially exceeds the 4–5 PSI required to overcome the force exerted by helical spring 102. In the preferred embodiment, helical spring 102 forces magnet plate 118 to contact the center of barrel end cap 122, which corresponds to the core of electromagnet 123. Thus, only during the brief interval of time after the electromagnet is de-energized is main valve stem 100 in the open position and helical spring 102 compressed. It is during this brief interval that the pneumatic pressure in pressure chamber 128 forces the main valve open. When the force of the pressure being exerted on the rear face of the head of main valve stem 100 falls below the force exerted by helical spring 102, the main valve rapidly closes.

Figure 6:
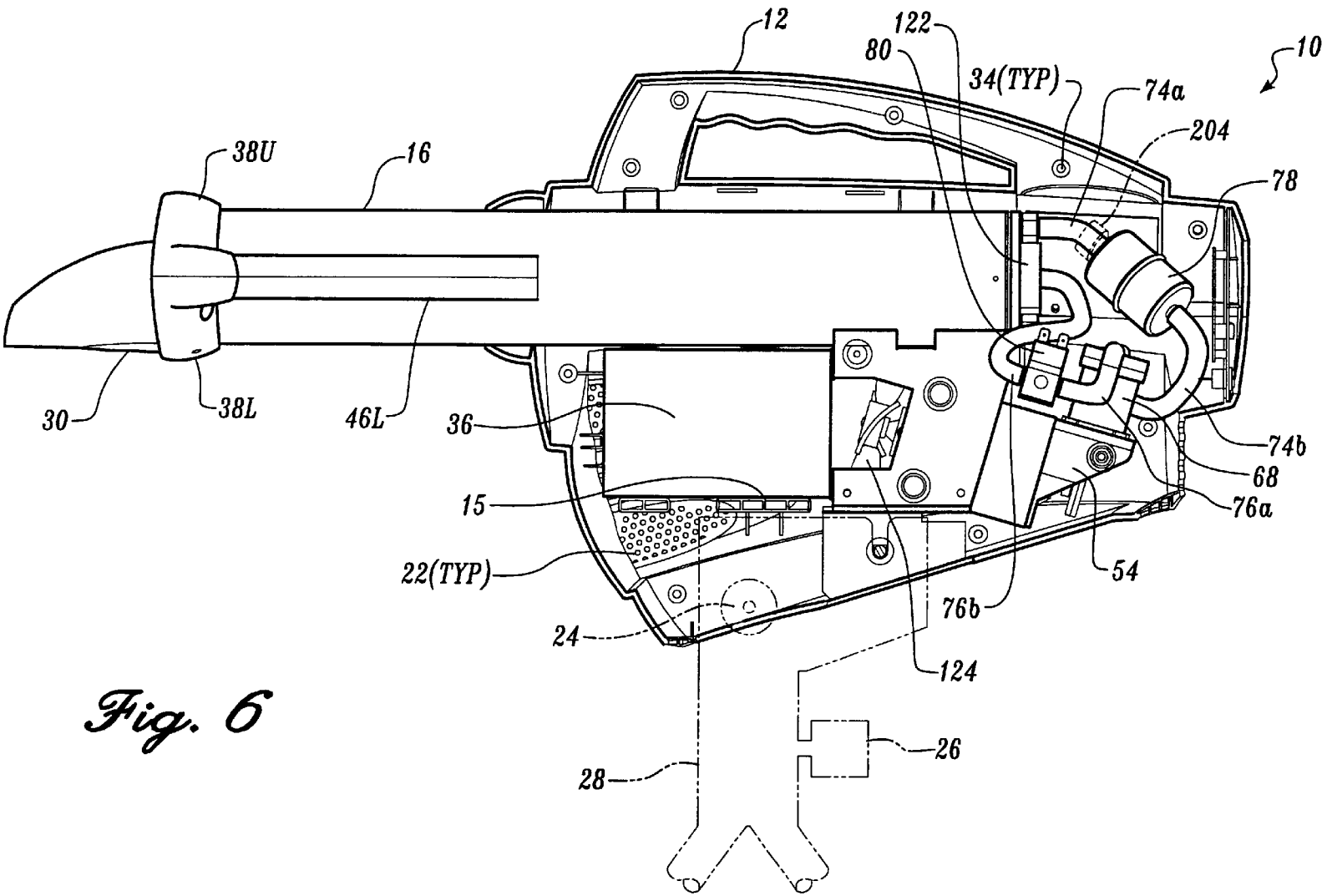
FIG. 6 is a side elevational view of the pneumatic device with a cover removed, to show the interior detail of the device.

With left housing shell 14L removed, as shown in FIG. 6, internal battery 36 can be clearly seen. The entirety of barrel 16 may be seen as well, including the portion of barrel 16 which is normally covered by the left housing shell. Impellers 124 of fan 53 on the end of motor 52 can be seen in this view, as well as drive housing 54 and cylinder 68. Compressor intake line 74*a* can be seen connected to air filter 78. Filtered air exiting air filter 78 moves through compressor intake line 74*b* into compressor 184. Compressed air then exits compressor 184 through compressor exhaust line 76*a* and moves to electrically actuated bleed valve 80. When bleed valve 80 is in the closed position, pressurized air flows through exhaust line 76*b* into pressure chamber 128 (not shown in FIG. 6), which is disposed inside barrel 16.

Figure 7:
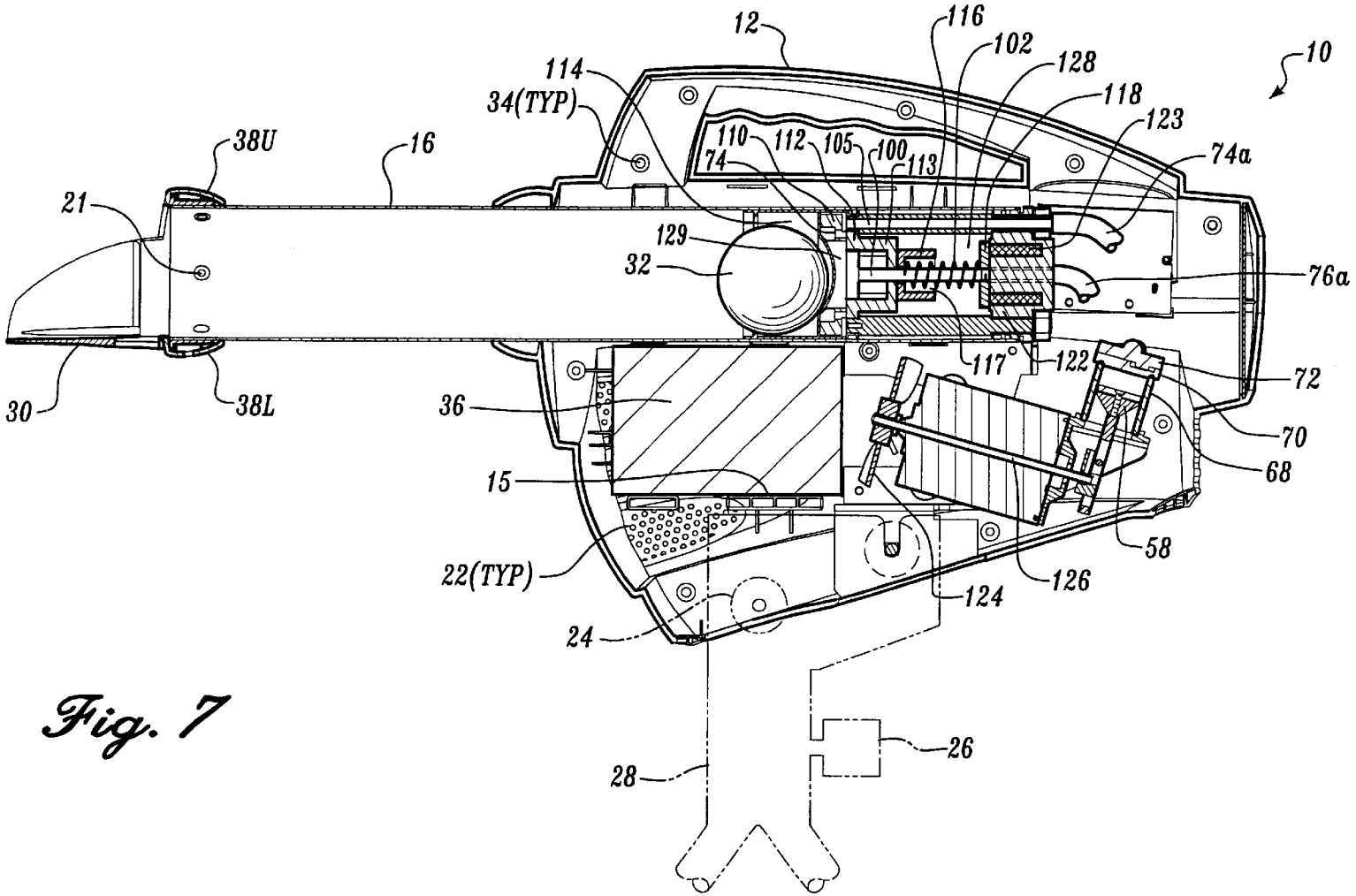
FIG. 7 is a side elevational cross-sectional view of the pneumatic device, showing a ball and a carrier for the projectile in a firing position.

FIG. 7 illustrates a cross-sectional view of the pneumatic device 10, in which the interiors of barrel 16 and pressure chamber 128 are visible. From this perspective, impellers 124 are also more clearly visible. Shaft 126 can also be seen driving eccentric crank wheel 56 (shown more clearly in FIG. 4). Other compressor 184 components, such as piston 58, cylinder 68, and valve plate 70 can also clearly be seen. Ball 32 can be seen inside barrel 16 in its firing position. Note that ball. 32 is resting inside the slight concave receptacle formed in the front surface of projectile carrier 114.

In the preferred embodiment, projectile carrier 114 is fabricated from a lightweight injection-molded plastic. A projectile carrier fabricated from a denser material, such as metal, would reduce the efficiency of pneumatic device 10 by requiring more energy be expended to accelerate the projectile carrier, leaving less energy available to accelerate the projectile. As briefly noted above, projectile carrier 114 preferably incorporates a concave surface that "cups" ball 32. As projectile carrier 114 is accelerated, ball 32 is firmly seated in the concave area, preventing the ball from contacting the interior surface of barrel 16, so that ball 32, which has a diameter smaller than that of barrel 16, can be fired without incurring errors in its trajectory might occur if the ball were to randomly strike the interior of the barrel. In the prior art, when a projectile strikes the interior surface of a barrel, damage to the sides of the barrel can sometimes occur, as well as a reduction in the accuracy of the projectile's trajectory.

It should be noted that the concave surface of projectile carrier 114 extends into a void space 129 at the front and center of spacer ring 110. If void space 129 is too large, energy from the pneumatic pressure inside pressure chamber 128 is wasted when the compressed air expands into void space 129 rather than be applied to driving projectile carrier 114 and ball 32 down barrel 16. If void space 129 is too small, the head of main valve stem 100 will strike the rear of projectile carrier 114 before it has advanced far enough down the barrel to avoid main valve stem 100. Such contact can damage either or both main valve stem 100 and projectile carrier 114. The depth of spacer ring 110, and the volume of void space 129 have been optimized to ensure that main valve stem 100 will not strike projectile carrier at any level within the range of pressures pneumatic device 10 is designed to achieve.

As illustrated in FIG. 7, main valve stem 100 is in its closed position, electromagnet 123 is energized, and magnet plate 118 is being held by the electromagnet. Compressor 184 is energized, bleed valve 80 is closed (projectile carrier is in its firing position), and compressed air is being accumulated in pressure chamber 128. Any air that compressor 184 requires is being drawn from barrel 16 behind projectile carrier 114, passing through the annular gap between the inside surface of barrel 16 and the periphery of projectile carrier 114, passing through hollow core bolt 105, through compressor intake line 74*a*, through filter 78, and into compressor 184.

FIG. 8 illustrates pneumatic device 10 just after the firing cycle has begun. Main valve stem 100 is shown in its fully open position. Magnet plate 118 has moved forward, impacting elastomeric bumper 16, and helical spring 102 is compressed within cavity 117 of elastomeric bumper 16. Ball 32 is approaching the mouth of barrel 16, and is about to pass optical sensor system 21.

Note that ball 32 and projectile carrier 114 are no longer in contact. The charge of compressed air released from pressure chamber 128 when the main valve opened has accelerated ball 32 and projectile carrier 114 to the same initial velocity. However, as the ball and projectile carrier advances toward the mouth of barrel 16, a low-pressure region develops between projectile carrier 114 and front plate 112. As projectile carrier 114 advances toward the front or mouth of barrel 16, this pressure becomes less than the ambient pressure, and a retarding force is exerted the ambient pressure on projectile carrier 114.

It will be recalled that the length of barrel 16 has been selected so that even at the highest velocity setting of which pneumatic device 10 is capable, the projectile carrier will stop before it is ejected from barrel 16. To further ensure that projectile carrier 114 is not ejected from barrel 16, elastomeric guard 30 has a small raised bead 33 formed on its inner surface. This bead is not so large as to interfere with ball 32, which has a smaller diameter than either barrel 16 or projectile carrier 114, but will catch projectile carrier 114, to prevent it moving past elastomeric guard 30.

Figure 9:
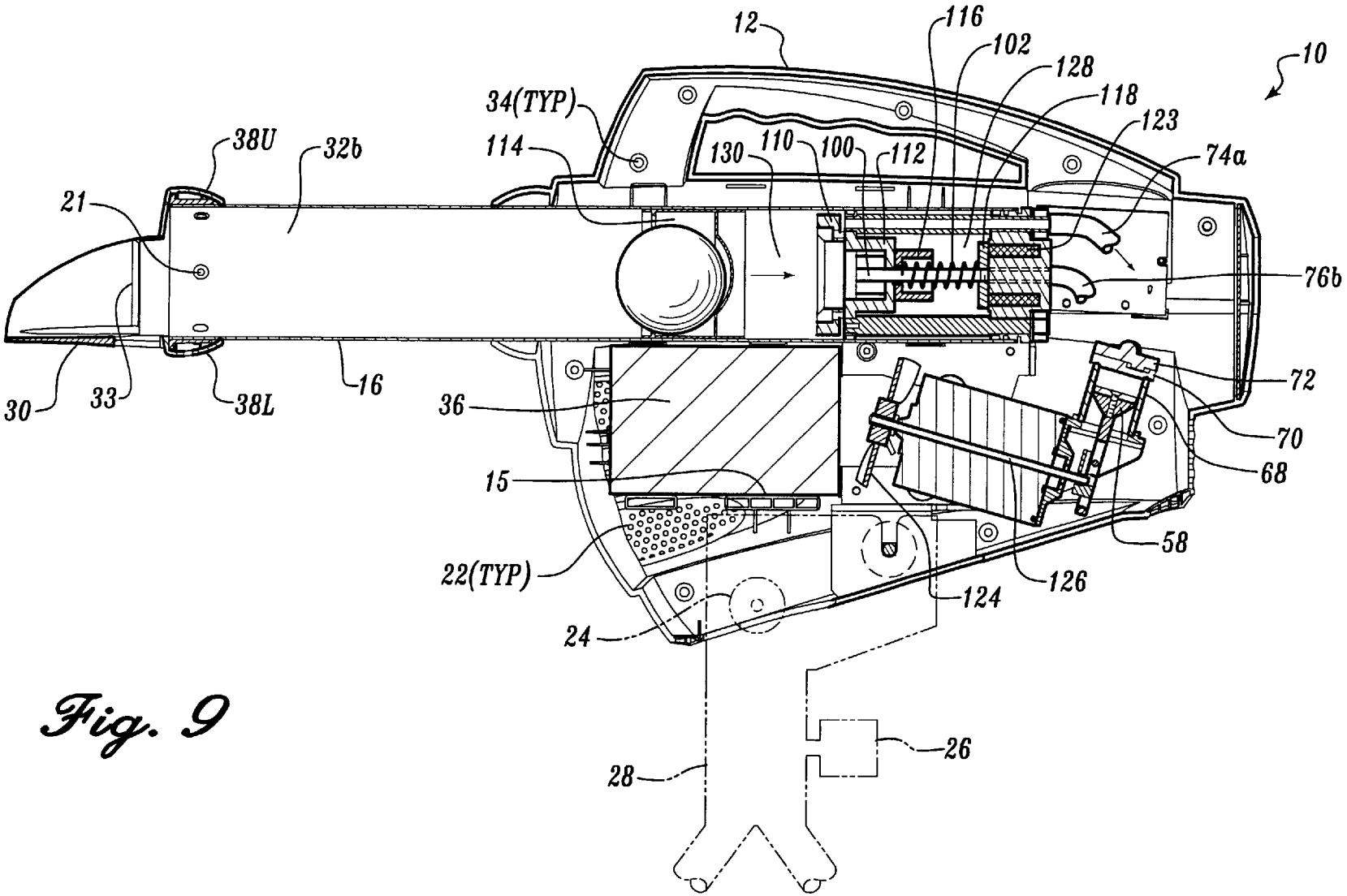
FIG. 9 is a side elevational cross-sectional view of the pneumatic device, showing the carrier being drawn back into a firing position to receive the next projectile.

FIG. 9 illustrates interior of pneumatic device 10 either after an initial ball is loaded into the barrel, or after any ball in a series of balls has been fired, and the next ball in the series is loaded into the barrel. This corresponds to the steps in the firing sequence detailed in blocks 162 or 179 of FIG. 3. At this point in the process, a projectile was loaded into barrel 16, which tripped optical sensor system 21, which then communicated that event to microprocessor 203, which in turn energized compressor 184. Compressor 184 is operating, creating a partial vacuum inside volume 130 behind projectile carrier 114, which enables ambient air pressure to force the projectile carrier (and the ball) back into its firing position, immediately adjacent to spacer rings 110. If the next shot in the firing sequence will be at a lower velocity, microprocessor 203 will open bleed valve 80 (shown in FIGS. 4 and 6) until projectile carrier 114 has returned to its firing position (as described with respect to block 179 in FIG. 3). If the next shot in the firing sequence is to be at the same or a higher velocity, bleed valve 80 remains closed and microprocessor 203 operates compressor 184 for the length of time required to fill pressure chamber 128 with compressed air at a pressure required to propel the next ball fired with the desired velocity (as described above with respect to block 162 in FIG. 3), while returning projectile carrier 114 to its proper firing position.

Figure 10:
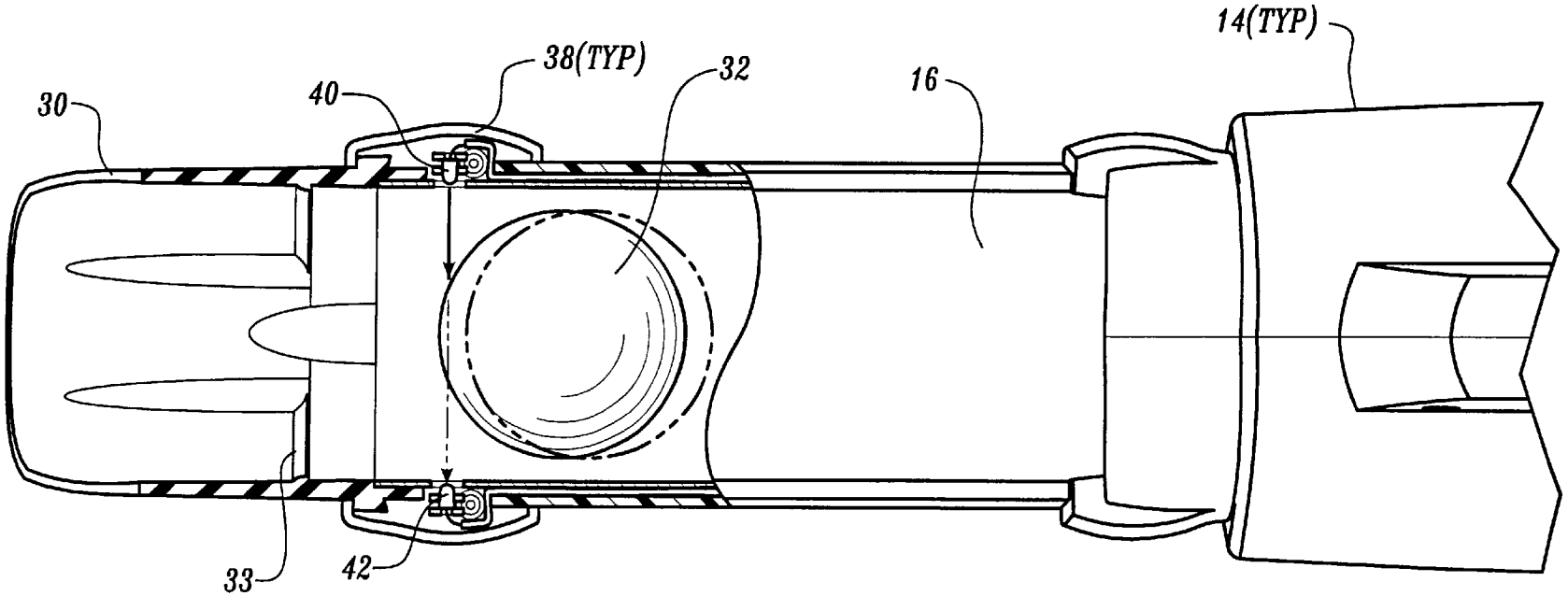
FIG. 10 is a top plan view of the pneumatic device, with a cutaway portion showing a ball as it just breaking an optical path between a light source and detector disposed near an end of the barrel.

FIG. 10 illustrates how optical sensor system 21 functions to detect the ball or projectile just fired, which enables the microprocessor to determine the initial velocity of the ball as it leaves the mouth of barrel 16. Ball 32 is shown in phantom view approaching optical sensor system 21. As shown in FIG. 10, a beam of light (indicated by arrows) emitted by optical emitter 40 is received by optical detector 42, which produces a signal in response thereto. When a ball, projectile, or other object interrupts this light beam, then the signal, which is received by microprocessor 203, changes accordingly. When an object, such as ball 32 interrupts the beam, a signal is sent to microprocessor 203. If pneumatic device 10 is turned on, the correct password has been entered, and the operator has entered firing parameters, then microprocessor 203 will interpret the change in the signal indicating the interruption of the light beam as an indication that a ball or other projectile has been loaded (see block 158 in FIG. 3), and the microprocessor will energize the compressor and initiate the firing sequence. If pneumatic device 10 has just fired a projectile, the signal indicating an interruption of the beam will cause microprocessor 203 to determine the velocity of the projectile based on the length of time, t, that the light beam is occluded by the ball and the known diameter, d, of the ball. Thus, the velocity, v is determined by:

$$v=d/t$$

This result will then be indicated on display 20.

As described with respect to block 166 of FIG. 3, optical sensor system 21 is used as a safety feature as well. As part of the firing sequence, prior to firing a projectile, microprocessor will determine if any obstruction is interrupting the light beam. Such-an obstruction could very well be an operator's hand or finger inside barrel 116. When the optical beam is interrupted at this point during a firing sequence, as a safety feature, microprocessor 203 prevents pneumatic device 10 from firing.

In another embodiment that is not shown, barrel 16 is rifled to increase the accuracy of the projectile trajectory, and the diameter of the projectile must be just slightly less than the that of the barrel. Because the preferred embodiment is directed to a device that preferably duplicates baseball pitches or tennis serves, barrel 16 is not rifled in the preferred embodiment described in detail above. The spin on a projectile that is induced by rifling (spinning around the axis of flight) does not duplicate the spin around an axis transverse to the direction of the line of flight of a ball, as is created in a curve ball pitch in baseball or by the topspin of a tennis serve. It is contemplated that a friction inducing material, such as a VELCRO™ patch or abrasive material, can be placed along the bottom of barrel 16 to cause a dropping curve ball with topspin.

Although the present invention has been described in connection with the preferred form of practicing it and modifications thereto as described above, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A device for ejecting a projectile, the device comprising:

(a) a barrel defining an inner space and having a closed end, and an open end through which the projectile is ejected;

(b) a chamber in which a charge of a compressed fluid having a pressure substantially greater than ambient air pressure is developed, said chamber being selectively coupled in fluid communication with the inner space of the barrel, so that the charge of compressed fluid is selectively released into the inner space of the barrel; and (c) a projectile carrier disposed generally adjacent to the closed end of the barrel when in a firing position, the projectile carrier having a rear surface upon which the compressed fluid acts when the charge of the compressed fluid is selectively released into the inner space of the barrel, the projectile carrier having a cross-sectional size sufficiently close to that of the barrel so as to move freely along the inner space of the barrel, while accelerating a projectile conveyed by the projectile carrier through the inner space when the charge of compressed fluid is selectively released into the barrel behind the projectile carrier, said projectile carrier imparting kinetic energy to the projectile when the projectile carrier is forced from its firing position by the charge of compressed fluid and ejecting the projectile from the barrel.

2. The device of claim 1, wherein the barrel is of sufficient length so that the projectile carrier is not propelled from the open end of the barrel, a pressure within the barrel in a volume area between the closed end of the barrel and the projectile carrier dropping to a level below ambient air pressure as the projectile carrier moves toward the open end of the barrel, and ambient air pressure causing the projectile carrier to stop before being ejected from the open end of the barrel.

3. The device of claim 1, wherein the chamber is disposed at the closed end of the barrel, and a valve is disposed between the chamber and the inner space of the barrel, the valve being selectively opened to release the charge of compressed fluid into the inner space behind the projectile carrier.

4. The device of claim 3, wherein the pressure of the compressed fluid developed in the chamber is selectively variable, and a velocity of the projectile as it is ejected is determined by developing an appropriate pressure in the pressure chamber to produce a desired velocity.

5. The device of claim 3, wherein the valve comprises an electromagnet that holds the valve closed when the electromagnet is energized with an electrical current.

6. The device of claim 3, wherein the valve comprises a return spring that returns the valve to a closed position.

7. The device of claim 3, wherein the valve is a high speed valve that when opened, dumps the charge of compressed fluid into the inner space of the barrel, behind the projectile carrier.

8. The device of claim 3, further comprising a compressor that produces the charge of compressed fluid in the chamber.

9. The device of claim 3, further comprising a bleed valve in fluid communication with the chamber, so that the compressed fluid in the chamber can be discharged without opening the valve.

10. The device of claim 8, further comprising a battery that is electrically coupled to the compressor to supply an electrical current to energize the compressor.

11. The device of claim 8, wherein after a projectile has been ejected from the open end of the barrel, the compressor draws air from the inner space behind the projectile carrier to create a partial vacuum within the inner space of the barrel, so that a force on the projectile carrier produced by ambient air pressure moves the projectile carrier back to its firing position.

12. The device of claim 11, wherein the device further comprises a bleed valve that is opened to exhaust compressed air produced by the compressor for at least a portion of a time during which the projectile carrier is being drawn back to its firing position, and then closed so that the compressor achieves a desired pressure in the chamber for ejecting a projectile.

13. The device of claim 12, wherein the bleed valve is opened when the compressor is developing a charge of compressed air in the chamber to eject a projectile at a substantially lower pressure than a previously ejected projectile.

14. The device of claim 12, wherein before the device is de-energized, the bleed valve is opened, thereby releasing any pressure within the chamber, thus preventing any projectile disposed in the barrel from being fired when the device is de-energized.

15. The device of claim 11, wherein the projectile carrier comprises a deformable material that is slightly larger in size than the cross-sectional size of the barrel, and wherein the pneumatic device further comprises a check valve through which the compressor is provided with intake air when the projectile carrier is in the firing position.

16. The device of claim 11, wherein a gap is defined between a periphery of the projectile carrier and an inner surface of the barrel and wherein said gap provides a sufficient amount of seepage so that when the projectile carrier is in its firing position, the compressor draws intake air through the gap.

17. The device of claim 1, wherein the projectile comprises a sports ball.

18. The device of claim 1, wherein a mass of the projectile carrier is substantially less than that of the projectile, so that substantially more of the kinetic energy provided by the compressed fluid is transferred to the projectile than to the projectile carrier.

19. The device of claim 1, wherein the projectile carrier has one of a raised rim and at least one spring clip to receive and retain the projectile within the projectile carrier, thereby generally preventing the projectile from disengaging from the projectile carrier if the barrel is tilted downwardly so that its open end is below the horizontal, until the charge of compressed fluid is released.

20. The device of claim 1, wherein the projectile carrier includes a shaped surface that centers the projectile within the barrel as the projectile is accelerated, minimizing random contacts between the projectile and an internal surface of the barrel, to ensure that the projectile achieves a desired trajectory.

21. The device of claim 20, wherein the shaped surface comprises a recess that can accommodate projectiles of different sizes, so that said projectiles of different size can be ejected using the same barrel and projectile carrier.

22. The device of claim 9, further comprising a controller electrically connected to the compressor to control a magnitude of the pressure developed in the chamber, the magnitude of the pressure being selected by the controller so that the projectile carrier is provided a kinetic energy by the charge of compressed fluid that is sufficient to eject the projectile along a desired trajectory with a desired velocity.

23. The device of claim 22, further comprising a plurality of controls and a display that are electrically coupled to the controller, said controller preventing the device from being operated until a correct password has been entered into the display using at least one of the plurality of controls.

24. The device of claim 22, wherein the controller comprises a microprocessor that is programmed to control the compressor and the valve in accord with a programmed sequence of steps.

25. The device of claim 22, wherein the controller controls the magnitude of the pressure of the compressed fluid in the chamber by controlling a length of time that the compressor is energized.

26. The device of claim 22, further comprising a pressure sensor electrically coupled to the controller and disposed to sense a pressure within the chamber, and wherein the controller controls the magnitude of the pressure of the compressed fluid in the chamber by de-energizing the compressor when said pressure sensor indicates that a desired pressure within the chamber has been obtained.

27. The device of claim 26, further comprising a bleed valve in fluid communication with the chamber, so that when the pressure sensor indicates that the pressure within the chamber exceeds the desired pressure, the compressed fluid in the chamber is discharged through the bleed valve without opening the valve.

28. The device of claim 22, wherein the compressor comprises:

(a) an intake in fluid communication with the inner space of the barrel, behind the projectile carrier, such that when the compressor is energized, the compressor creates a partial vacuum that causes the projectile carrier to be pushed back to its firing position by ambient air pressure; and (b) an exhaust in fluid communication with a bleed valve, wherein:

(i) said bleed valve enables fluid communication between the exhaust and the chamber when the bleed valve is closed, so that when the compressor is energized and said bleed valve is closed, the compressor fills the pressure chamber with the charge of compressed fluid at a required pressure;

(ii) said bleed valve enables fluid communication with ambient air when the bleed valve is open;

(iii) the controller opens the bleed valve when a first time period that the compressor is required to operate to ensure that the projectile carrier has returned to the firing position is greater than a second time period that the compressor is required to operate to ensure that the pressure chamber is filled with the compressed fluid at the required pressure, the controller opening the bleed valve and operating the compressor for a time period that is equal to a difference between the first and second time periods, and then closing the bleed valve and operating the compressor for a time period that is equal to the second time period; and otherwise (iv) the controller leaves the bleed valve closed.

29. The device of claim 24, further comprising an optical sensor disposed adjacent to the open end of the barrel and electrically coupled to the microprocessor, the optical sensor producing a signal that is conveyed to the microprocessor, said signal changing in response to a projectile being loaded into the open end of the barrel, causing the microprocessor to initiate a firing sequence by energizing the compressor for a time sufficient to develop a pressure in the chamber that will eject the projectile with the desired velocity.

30. The device of claim 29, wherein the microprocessor is programmed to abort the firing sequence if the signal from the optical sensor indicates that an obstruction has been detected in the barrel.

31. The device of claim 29, further comprising a display that is coupled to the microprocessor, wherein the optical sensor detects a projectile being ejected from the barrel, causing the signal conveyed to the microprocessor to change, said microprocessor determining a velocity of the projectile in response to the signal from the optical sensor and indicating the velocity on the display.

32. The device of claim 1, wherein the device is adapted to be mounted to a tripod.

33. The device of claim 1, further comprising a housing that substantially encloses components of the device.

34. The device of claim 33, wherein the housing comprises a carrying handle.

35. The device of claim 1, further comprising a pivot adjustment and a tilt adjustment to enable a desired trajectory of the projectile to be selectively controlled.

36. The device of claim 1, wherein the device is selectively energized by an internal storage battery or an external power source.

37. The device of claim 36, wherein the internal storage battery is rechargeable.

38. Apparatus for imparting a desired trajectory to a projectile, comprising:

(a) a tubular member defining an inner space, said tubular member having a front end and a rear end, the front end being open;

(b) a chamber having an inlet and an outlet, said outlet being coupled to the inner space through a port at the rear end of the tubular member via a fluid path that is sealed by a valve that is electromagnetically controlled;

(c) a compressor having an intake and exhaust, said exhaust being coupled in fluid communication with the inlet of the chamber, and said intake being coupled in fluid communication with the inner space adjacent to the rear end of the tubular member, said compressor developing a charge of compressed air within the chamber; and (d) a projectile carrier disposed within said tubular member, said projectile carrier having a firing position in which it is disposed in front of the port at the rear of the tubular member, such that when said valve opens, the projectile carrier is initially accelerated toward the front end of the tubular member by the charge of compressed air, thereby imparting kinetic energy to a projectile that is disposed in front of the projectile carrier, so that the projectile is ejected from the front end of the tubular member along the desired trajectory.

39. The apparatus of claim 38, wherein the tubular member is sufficiently long that the projectile carrier stops moving toward the front end of the tubular member before being ejected.

40. The apparatus of claim 38, wherein the chamber is disposed within the rear end of the tubular member.

41. The apparatus of claim 38, further comprising a housing adapted to mount to a supporting tripod, said housing having a pan adjustment and a tilt adjustment to enable the desired trajectory to be selectively set.

42. The apparatus of claim 38, further comprising a shelf extending from the front end of the tubular member to support a projectile being loaded into the tubular member.

43. The apparatus of claim 38, wherein after ejecting the projectile, the intake of the compressor draws air from the inner space of the tubular member, producing a partial vacuum in said inner space that causes the projectile carrier to move through the tubular member to the firing position of the projectile carrier.

44. The apparatus of claim 38, further comprising:

(a) an optical sensor disposed adjacent to the front end of the tubular member, such that a projectile being ejected from the tubular member causes a change in a signal produced by the optical sensor;

(b) a control panel and a display; and (c) a microprocessor electrically connected to the compressor, the optical sensor, the control panel, the display, and an electromagnetic coil of the valve, said microprocessor controlling a firing sequence to eject a projectile from the tubular member in accord with a parameter entered using the control panel and the display, and responsive to the signal from the optical sensor.

45. The apparatus of claim 44, wherein the microprocessor is programmed to enable an operator to use the control panel to select a desired velocity for the projectile, and to control the compressor so as to determine a pressure of the charge of compressed air within the chamber needed to achieve the desired velocity.

46. The apparatus of claim 44, wherein the microprocessor enables an operator to select a series of programmed firing sequences for ejecting a succession of projectiles from the tubular member.

47. The apparatus of claim 44, wherein the display indicates a velocity of the projectile ejected from the tubular member in response to the signal provided by the optical sensor.

48. The apparatus of claim 44, wherein the microprocessor prevents a projectile from being fired when the signal from the optical sensor indicates that an obstruction has been detected thereby at the front end of the tubular member.

49. The apparatus of claim 44, wherein during the firing sequence, the microprocessor closes the valve, energizes the compressor, using the air drawing into the intake of the compressor to position the projectile carrier in its firing position, and fills the chamber with the charge of compressed air to a pressure required to impart a desired velocity to the projectile when it is ejected, said firing sequence being initiated in response to the signal from the optical sensor indicating that a projectile has been loaded into the front end of the tubular member.

50. The apparatus of claim 44, further comprising:

(a) an electrically-actuated bleed valve that is electrically connected to the microprocessor and is connected in a path providing fluid communication between the exhaust of the compressor and the inlet of the chamber, said bleed valve, when opened by the microprocessor, venting the compressor exhaust to ambient, and when closed, enabling compressed air from the exhaust of the compressor to flow into the inlet of the chamber; and (b) wherein the controller opens said bleed valve when a first time period that is sufficient to return the projectile carrier to its firing position is greater than a second time period that is sufficient to fill the chamber with the charge of compressed air at a pressure required to eject the projectile from the tubular member with a desired velocity, the controller first opening the bleed valve for a time period that is equal to a difference between the first and second time periods, and then closing the bleed valve and operating the compressor for a time period that is equal to the second time period.

51. The apparatus of claim 50, further comprising a battery that supplies electrical power to:

(a) the microprocessor;

(b) the valve that is electromagnetically actuated;

(c) the optical sensor;

(d) the compressor; and (e) the electrically actuated bleed valve.

52. The apparatus of claim 38, further comprising a housing that substantially encloses the apparatus.

53. The apparatus of claim 52, wherein the housing includes a handle that facilitates carrying the apparatus to a site where it will be used.

54. A device for ejecting a projectile, the device comprising:

(a) a barrel defining an inner space and having a closed end, and an open end through which the projectile is ejected;

(b) a chamber in which a charge of a compressed fluid having a pressure substantially greater than ambient air pressure is developed, said chamber being selectively coupled in fluid communication with the inner space of the barrel, so that the charge of compressed fluid is selectively released into the inner space of the barrel; and (c) a projectile carrier disposed generally adjacent to the closed end of the barrel when in a firing position, the projectile carrier remaining unattached to a projectile and having a cross-sectional size sufficiently close to that of the barrel so as to move freely along the inner space of the barrel, while accelerating an unattached projectile conveyed by the projectile carrier through the inner space when the charge of compressed fluid is selectively released into the barrel behind the projectile carrier, said projectile carrier imparting kinetic energy to the unattached projectile when the projectile carrier is forced from its firing position by the charge of compressed fluid and ejecting the unattached projectile from the barrel.

55. A method for propelling a projectile along a trajectory, the method comprising the steps of:

(a) providing:

(i) a tubular member for directing the projectile out from an open end of the tubular member;

(ii) a projectile carrier having a cross-sectional size substantially equal to that of the tubular member;

(iii) a projectile having a cross-sectional size less than that of the tubular member; and (iv) a charge of compressed fluid;

(b) loading the projectile into the tubular member so that the projectile is adjacent to but not attached to the projectile carrier;

(c) positioning the projectile carrier in a firing position within the tubular member; and (d) rapidly releasing the charge of compressed fluid into the tubular member so that the compressed fluid acts on the projectile carrier and accelerates the projectile carrier and the projectile through the tubular member, said projectile being thus propelled from the tubular member along the trajectory.

56. A method for propelling a projectile along a trajectory, the method comprising the steps of:

(a) providing:

(i) a tubular member for directing the projectile out from an open end of the tubular member;

(ii) a projectile having a cross-sectional size less then that of the tubular member;

(iii) a projectile carrier having a cross-sectional size substantially equal to that of the tubular member, wherein the projectile carrier has one of a raised rim and at least one spring clip to receive and retain the projectile within the projectile carrier, thereby generally preventing the projectile from disengaging form the projectile carrier if the tubular member is tilted downwardly with its open end disposed below the horizontal, until a charge of compressed fluid is released; and (iv) a charge of compressed fluid;

(b) loading the projectile into the tubular member so that the projectile is adjacent to the projectile carrier;

(c) positioning the projectile carrier in a firing position within the tubular member; and (d) rapidly releasing the charge of compressed fluid into the tubular member so that the compressed fluid acts on the projectile carrier and accelerates the projectile carrier and the projectile through the tubular member, said projectile being thus propelled from the tubular member along the trajectory.

57. A method for propelling a projectile along a trajectory, the method comprising the steps of:

(a) providing:

(i) a tubular member for directing the projectile out from an open end of the tubular member;

(ii) a projectile having a cross-sectional size less then that of the tubular member;

(iii) a projectile carrier having a cross-sectional size substantially equal to that of the tubular member; and (iv) a charge of compressed fluid that is developed using a compressor having an intake and an exhaust, said intake being coupled in fluid communication with a volume of the tubular member that is disposed behind the projectile carrier;

(b) loading the projectile into the tubular member so that the projectile is adjacent to the projectile carrier;

(c) positioning the projectile carrier in a firing position within the tubular member by energizing the compressor to create a partial vacuum in the volume of the tubular member that causes the projectile carrier to be moved through the tubular member and into the firing position; and (d) rapidly releasing the charge of compressed fluid into the tubular member so that the compressed fluid acts on the projectile carrier and accelerates the projectile carrier and the projectile through the tubular member, said projectile being thus propelled from the tubular member along the trajectory.

58. A method for propelling a projectile along a trajectory, the method comprising the steps of:

(a) providing:

(i) a tubular member for directing the projectile out from an open end of the tubular member;

(ii) a projectile having a cross-sectional size less then that of the tubular member;

(iii) a projectile carrier having a cross-sectional size substantially equal to that of the tubular member; and (iv) a charge of compressed fluid that is disposed within a chamber, the chamber being in fluid communication with the tubular member along a path that is sealed with a valve;

(b) loading the projectile into the tubular member so that the projectile is adjacent to the projectile carrier;

(c) positioning the projectile carrier in a firing position within the tubular member; and (d) rapidly releasing the charge of compressed fluid into the tubular member by opening the valve, so that the compressed fluid acts on the projectile carrier and accelerates the projectile carrier and the projectile through the tubular member, said projectile being thus propelled from the tubular member along the trajectory.

59. The method of claim 58, wherein the valve is electromagnetically controlled, the step of rapidly releasing the charge of compressed fluid by opening the valve comprising the step of interrupting an electrical current so that a pressure of the compressed fluid causes the valve to rapidly open.

60. A method for propelling a projectile along a trajectory, the method comprising the steps of:

(a) providing:

(i) a tubular member for directing the projectile out from an open end of the tubular member;

(ii) a projectile having a cross-sectional size less then that of the tubular member;

(iii) a projectile carrier having a cross-sectional size substantially equal to that of the tubular member; and (iv) a charge of compressed fluid;

(b) loading the projectile into the tubular member so that the projectile is adjacent to the projectile carrier;

(c) positioning the projectile carrier in a firing position within the tubular member;

(d) rapidly releasing the charge of compressed fluid into the tubular member so that the compressed fluid acts on the projectile carrier and accelerates the projectile carrier and the projectile through the tubular member, said projectile being thus propelled from the tubular member along the trajectory; and (e) determining a velocity of the projectile as it is ejected from the tubular member.

61. The method of claim 60, further comprising the steps of determining whether an obstruction is blocking the tubular member; and if so, aborting the rapid release of the charge of compressed fluid into the tubular member so that the projectile carrier and projectile are not accelerated.

* * * * *